US007459256B2

(12) United States Patent
Itami et al.

(10) Patent No.: US 7,459,256 B2
(45) Date of Patent: Dec. 2, 2008

(54) IMAGE FORMING METHOD AND IMAGE FORMING APPARATUS

(75) Inventors: Akihiko Itami, Hachioji (JP); Kunio Shigeta, Hachioji (JP); Shigeaki Tokutake, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 499 days.

(21) Appl. No.: 11/235,230

(22) Filed: Sep. 26, 2005

(65) Prior Publication Data

US 2006/0166127 A1 Jul. 27, 2006

(30) Foreign Application Priority Data

Jan. 21, 2005 (JP) ..... 2005-013887

(51) Int. Cl.
*G03G 15/09* (2006.01)

(52) U.S. Cl. ..... 430/122.2; 430/122.8; 430/123.4; 430/123.41

(58) Field of Classification Search ..... 430/122.2, 430/122.8, 123.4, 123.41
See application file for complete search history.

(56) References Cited

U.S. PATENT DOCUMENTS 6,078,768 A * 6/2000 Suzuki ..... 399/257
2006/0115761 A1 6/2006 Itami et al.
2006/0120766 A1 6/2006 Itami et al.

FOREIGN PATENT DOCUMENTS

| | | |
|---|---|---|
| JP | 58189061 | 11/1983 |
| JP | 1118137 | 5/1989 |
| JP | 1118138 | 5/1989 |
| JP | 11292559 | 7/1999 |
| JP | 2000250239 | 9/2000 |
| JP | 2001125435 | 5/2001 |
| JP | 2003241569 | 8/2003 |
| JP | 2003255585 | 9/2003 |
| JP | 2003316036 | 11/2003 |
| JP | 2003316203 | 11/2003 |
| JP | 2004004454 | 1/2004 |

* cited by examiner

*Primary Examiner*—Hoa V Le
(74) *Attorney, Agent, or Firm*—Lucas & Mercanti, LLP

(57) ABSTRACT

There are described an image forming method and apparatus, which enable to form an electrophotographic image having high image density and excellent color reproducibility. The method includes: applying a uniform surface potential to an organic photoreceptor; irradiating light, having a wavelength in a range of 350-500 nm, on the photoreceptor, to form a latent image on the photoreceptor; and contacting a developing blush, containing toner and carrier, with the organic photoreceptor so as to form a visible toner image. The developing sleeve bears developing agent including the toner and the carrier. An absolute value of an electric charge potential of non-exposed area on the organic photoreceptor is in a range of 250-450 Volts and the developing sleeve is rotated in a counter direction, being counter to a rotating direction of the organic photoreceptor.

14 Claims, 3 Drawing Sheets

IMAGE FORMING METHOD AND IMAGE FORMING APPARATUS

BACKGROUND

The present invention relates to an image forming method and an image forming apparatus which are utilized in electrophotographic image formation, and particularly relates to an image forming method and an image forming apparatus which are utilized in electrophotographic image formation in the field of copiers and printers.

In recent years, electrophotographic copiers and printers come to be more often utilized in printing and color printing applications. In said printing and color printing applications, digital black and white images or color images having high image quality are strongly required. For this demand, it is proposed to form a high precision digital image by use of laser light having a short wavelength as an exposure light source (Patent literature 1). However, it is a present state that an electrophotographic image finally obtained cannot achieve sufficiently high quality even when a precise electrostatic latent image is formed on an electrophotographic photoreceptor.

The reason lies in that latent image formation on an electrophotographic photoreceptor or suitable development conditions have not been made sufficiently clear and that an image forming method, which is provided with the both of precise dot latent image formation and development conditions required for toner image formation based on said dot latent image, has not been established.

That is, as an electrophotographic photoreceptor, a precise electrostatic latent image is not necessarily formed even when image exposure is performed with short wavelength laser light employing an organic photoreceptor which has been developed for short wavelength laser application, and further, in successive development, individual dot images cannot be reproduced or may be lost because a development method to independently reproduce said latent image at high density has not been sufficiently established, resulting in not achieving sufficiently precise electrophotographic image.

Further, as a development mode, particularly, as a development mode of a latent image on an organic photoreceptor, a development mode, in which a development sleeve, equipped to oppose an organic photoreceptor, proceeds in parallel to the progressive direction of an organic photoreceptor in a development section (hereinafter, referred to as a parallel development mode), and a development mode, in which the sleeve proceeds in the counter direction (hereinafter, referred to as a counter development mode) are known (Patent literature 2), however, neither of them have sufficiently solved the problems to achieve precise dot image formation.

In a development mode, in which a development sleeve, equipped to oppose an organic photoreceptor, proceeds in parallel to the progressive direction of an organic photoreceptor, developability around high density images may be deteriorated to cause density decrease, resulting in deterioration of image quality particularly with such as a high contrast photographic image.

On the other hand, in a development mode, in which the sleeve proceeds in the counter direction, developability is high to enable formation of dot images having high density, however, fog or insufficient density in the top portion is liable to be generated.

Phenomena as described above cannot be solved only by improvement of a developer, but has been proved to be emphasized or improved also depending on characteristics of an organic photoreceptor.

That is, they are related to contrast of an electrostatic latent image formed on an organic photoreceptor and generation of a reversely charged toner due to rubbing between an organic photoreceptor and a developer.

In other words, in a counter development mode, a reversely charged toner is liable to be generated by contact rubbing between an organic photoreceptor and a toner, so that fog and spattering of a toner may be caused or density decrease in the top portion is liable to be generated resulting in making reproduction of a precise electrostatic latent image as a toner image impossible.

Further, in a development mode utilizing a two-component developer, proposed has been a ferrite carrier, which makes development of a latent image on a photoreceptor soft by use of a carrier having low saturation magnetization (Patent literature 3). However, no technique to effectively apply such a soft developer into a counter development mode has been proposed.

[Patent literature 1] JP-A No. 2000-250239 (Hereinafter, JP-A refers to Japanese Patent Publication Open to Public Inspection.)

[Patent literature 2] JP-A No. 2001-125465

[Patent literature 3] JP-A No. 11-202559

SUMMARY

An object of the invention is to solve problems of conventional techniques such as described above and to provide an electrophotographic image which exhibits high image quality and high precision. The invention aims to form a high precision electrostatic latent image by such as a short wavelength laser and to form a toner image having high precision and high image quality based on said electrostatic latent image, and relates to an image forming method to stably form a high precision digital image. More specifically, an object of this invention is to prevent image unevenness due to density decrease in the top portion after forming a high precision electrostatic latent image and to provide an image forming method and an image forming apparatus which enable to form an electrophotographic image having high image density and excellent color reproducibility.

An aspect of the invention is an image forming method which comprises:

applying a uniform surface potential to an organic photoreceptor by a charging device;

irradiating light having a wavelength in a range of 350 to 500 nm and emitted from a semiconductor laser or a light emitting diode which is equipped in an exposed device, on said photoreceptor, to form a latent image; and contacting a developing blush, which is formed on a developing sleeve and contains toner and carrier, with said photoreceptor having said latent image so as to form a visible toner image, wherein said developing sleeve is equipped in a developing device;

wherein an absolute value of an electric charge potential of a non-exposed area residing on said organic photoreceptor is in a range of 250 to 450 Volts at an exposing position of said exposing device; and wherein said developing sleeve is rotated in a counter direction, being counter to a rotating direction of said organic photoreceptor.

Another aspect is an image forming apparatus, which comprises:

a charging device to apply a uniform surface potential to an organic photoreceptor;

an exposing device that includes a semiconductor laser or a light emitting diode for emitting light having a wavelength in a range of 350 to 500 nm, so as to form a latent image; and a developing device that includes a developing sleeve which holds a developing blush containing toner and carrier, wherein said developing blush contacts said photoreceptor so as to form a visible toner image, wherein an absolute value of an electric charge potential of a non-exposed area residing on said photoreceptor is in a range of 250 to 450 Volts at an exposing position of said exposing device; and wherein said developing sleeve is rotated in a counter direction, being counter to a rotating direction of said photoreceptor.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
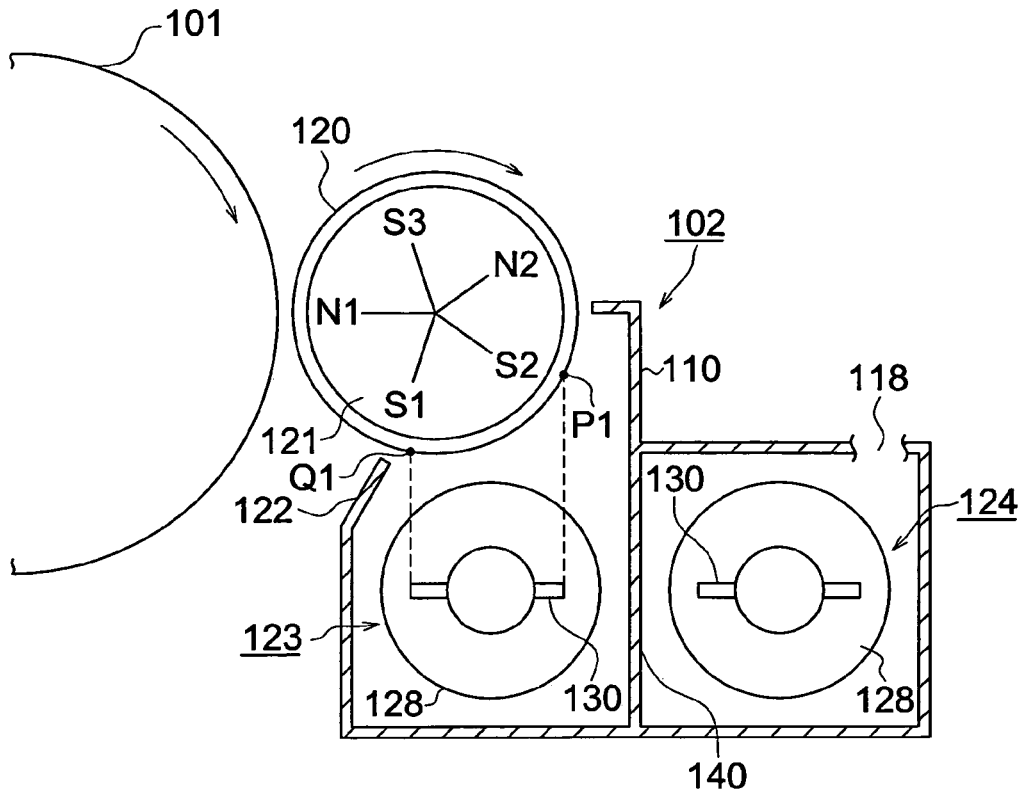
FIG. 1 is a sectional view of an example of a developing device employing a counter developing method.

The inventors of this invention have found that, to solve problems as described above, that is, for the purpose of forming a high precision electrostatic latent image by use of such as a short wavelength laser and forming a toner image having high density and high precision based on said electrostatic latent image, a toner image exhibiting high precision and high image quality can be obtained by forming an electrostatic latent image on an organic photoreceptor under a condition of a lower electric potential and developing said latent image by means of a counter development mode and utilizing a soft developer, which achieved this invention.

Hereinafter, the present invention will be explained in detail.

An embodiment of the invention is an image forming method, in which after applying a uniform surface potential on an organic photoreceptor by a charging device, an electrostatic latent image of a digital image is formed by an exposure device utilizing a semiconductor laser or an emission diode having an emission wavelength of 350-500 nm as a writing light source, and said electrostatic latent image is developed as a visible toner image by contacting a development sleeve carrying a developer, which contains a toner and a carrier, with the organic photoreceptor in a development device, wherein an absolute value of charge potential of the unexposed portion of the photoreceptor at the exposure position in the exposure device is 250-450 V, a volume average particle size of the carrier being 10-60 μm, a saturation magnetization being 20-80 emu/g, and an electrostatic image is developed as a toner image by rotating the development sleeve toward the counter direction against the rotational direction of the organic photoreceptor.

Further, an embodiment of the invention is an image forming method, in which a plural number of image forming units provided with a charging device which applies a uniform surface potential on an organic photoreceptor, an exposure device which forms an electrostatic latent image of a digital image by use of a semiconductor laser or an emission diode having an emission wavelength of 350-500 nm as a writing light source, a development device which arranges a development sleeve, holding a developer comprised of a toner and a carrier, in contact with the organic photoreceptor and develops said electrostatic latent image into a toner image, and a transfer device to transfer a toner image formed on the organic photoreceptor to a transfer medium, are arranging provided, each color toner image being formed on an organic photoreceptor by utilizing a toner which changes color for each of said plural number of image forming units, and a color image is formed by transferring said each color image onto a transfer medium from the organic photoreceptor; wherein an absolute value of charge potential in the unexposed portion of an photoreceptor at the exposure position in the aforesaid exposure means is 250-450 V, a volume average particle size of the carrier being 10-60 μm, a saturation magnetization being 20-80 emu/g, and an electrostatic image is developed into a toner image by rotating a development sleeve toward the counter direction against the rotational direction of an organic photoreceptor.

An image forming method of this invention can form a high precision electrostatic latent image of a dot image (a digital image) and develop said electrostatic latent image into a toner image having high image quality by means of a counter development mode, resulting in providing a digital image or a color image having high image quality.

An image forming method of this invention is an image forming method, in which an electrostatic latent image is formed on an organic photoreceptor under a condition of an absolute value of surface potential being 250-450 V, utilizing a semiconductor laser or an emission diode having an emission wavelength of 350-500 nm as a writing light source, and said electrostatic latent image is developed into a toner image by means of a counter development mode by contacting a development sleeve holding a developer, which contains a toner and a carrier, with an organic photoreceptor.

At the time of forming minute dot exposure with such as a short wavelength laser on an organic photoreceptor, there is a tendency to grow a dot latent image when surface potential of an organic photoreceptor is high. That is, it is considered that a dot latent image is liable to grow because diffusion of a carrier generated by exposure becomes large in a state of high surface potential. In this invention, to prevent a dot image from growing and to decrease growth of a dot latent image, which is exposed by a short wavelength laser, so that to form a dot latent image clearly, an electrostatic latent image of a digital image is formed under a condition of an absolute value of charge potential on an organic photoreceptor of 250-450 V (in this invention, a potential measured in a non-image portion at the exposure position), by use of a semiconductor laser or an emission diode having an emission wavelength of 350-500 nm as a writing light source. The resulting precise and clear dot image is developed into a toner image by contact development of a counter development mode.

When the above-described charge potential is less than 250 V, potential difference (difference between potential of the unexposed portion and potential of the exposed portion) necessary for development is small, resulting in insufficient image density. While, when the above-described charge potential is over 450 V, a dot latent image is liable to grow as described above, resulting in decreased merit of employing a short wavelength laser and a worm-like unevenness tend to take place. Although the cause of this worm-like unevenness has not clarified sufficiently, it may be considered that when a relative velocity between a photoreceptor and a developing sleeve becomes faster and a triboelectric charging between a magnetic brush of a developer and a photoreceptor becomes stronger, the worm-like unevenness may occur. Further, when a high quality image is formed with a short wavelength exposure light source, the worm-like unevenness may occur more.

In this invention, it is possible to develop an electrostatic image, formed in the above manner, into a toner image having high precision and high image quality by soft developing the electrostatic latent image by means of a counter development mode by use of a developer containing the following carrier.

In the following, a developer according to this invention will be described.

A developer of this invention is a two-component developer containing a toner and a carrier, wherein said carrier has a volume average particle size of 10-60 μm and a saturation magnetization value of 20-80 emu/g, more preferably 30-65 emu/g.

(Carrier)

Carrier has a volume average particle size of 10-60 μm and a saturation magnetization value of 20-80 emu/g. By utilizing a carrier having a small particle size and a small saturation magnetization value as described, a magnetic brush on a development sleeve becomes soft enabling development with soft touch, resulting in prevention of fog, and density decrease at the top portion.

As magnetic substance particles of a carrier utilized in this invention, such as iron powder, magnetite and various types of ferrite and preferably magnetite and various types of ferrite can be utilized.

Among ferrite carriers, a ferrite carrier provided with following general formula (1) may be preferable:

$$(MnO)_x(MgO)_y(Fe_2O_3)_z$$

wherein, x+y+z=100 mol %, and as a basic composition, x, y and z each are preferably in a range of 5-35 mol %, 10-45 mol % and 45-55 mol %, respectively, and specifically preferably in a range of 7.5-12.5 mol %, 35-45 mol % and 45-55 mol %.

Further, it may be preferable that a part of MnO, MgO and $Fe_2O_3$ is substituted by $SnO_2$. The substitution amount of $SnO_2$ is preferably 0.5-5.0 mol % and specifically preferably 0.5-3.0 mol %. When the substitution amount of $SnO_2$ is in a range of 0.5-5.0 mol %, the head on a magnetic brush becomes soft to enable soft development because a carrier having a low saturation magnetization is stably obtained, and stabilization of carrier characteristics after resin coating is possible because a carrier having a uniform surface is obtained, resulting in a ferrite carrier having excellent image quality and durability, being environmentally gentle and long lived, as well as superior in environmental stability.

The particle size of a carrier is preferably 10-60 μm and more preferably 15-55 μm based on a volume average particle size. When the volume average particle size is less than 10 μm, a carrier is liable to be spattered to cause adhesion of a carrier on a photoreceptor, while, when the size is over 60 μm, the head of a magnetic brush becomes coarse to make adaptation to a soft development mode difficult.

A volume average particle size is median diameter $D_{50}$ based on a volume measured by a laser diffraction type particle size analyzer, "HELOS" (manufactured by Synpatech Co., Ltd) equipped with a wet type disperser. Actually, in the wet type disperser, carrier, water, and several drops of surfactant are adjusted to become a density within a measurement and are provided for the measurement.

A magnetization characteristic, with which magnetic substance particles themselves of a carrier are provided, is preferably 20-80 emu/g, more preferably 30-65 emu/g based on saturation magnetization. When a saturation magnetization is less than 20 emu/g, adhesion of a carrier on an image forming substance may be caused due to a small magnetic binding force against a development sleeve and an image having high density cannot be obtained due to decreased size of a magnetic brush. While, in the case of over 80 emu/g, a magnetic brush becomes hard to easily cause density decrease at the top portion in a counter development mode.

Saturation magnetization is measured by use of "a small full automatic oscillating sampling type magnetometer (VSM-C7-10A)" (manufactured by Toei Industries). Concretely, a cell having a prescribed diameter of 6 mm is filled up with 20-50 mg of samples and is covered. Then, the cell is set in a device and the sample is measured in maximum field 10 kOe and the saturation magnetization is read and obtained from a magnetization curve.

(Resin Coating of Carrier)

A carrier is comprised of magnetic substance particles as a core material (a core), the surface of which is preferably coated with resin. The carrier may be the one which magnetic particles are dispersed in a binder resin. Resin utilized to coat the above-described carrier core material is not specifically limited, and employed can be various types of resin. For a positive charging toner, utilized can be such as fluorine type resin, fluorine-acryl type resin, silicone type resin and modified silicone type resin, and preferable is silicone type resin of a condensed type. On the other hand, for a negative charging toner, listed are such as acryl-styrene type resin, mixed resin of acryl-styrene type resin and melamine type resin, cured resin thereof, silicone type resin, modified silicone type resin, epoxy type resin, polyester type resin, urethane type resin and polyethylene type resin, and preferable are mixed resin of acryl-styrene type resin and melamine type resin, cured resin thereof and silicone type resin of a condensed type. Further, such as a charge controlling agent, an adhesion enhancing agent, a primer processing agent or a resistance controlling agent may be appropriately added.

As coating resin, siloxane type resin is preferably utilized, and those having a cross-link structure in resin are preferable. Siloxane resin includes silicone type resin. The structure of this silicone type resin is preferably represented by following general formulas (2) and (3).

[Chemical Structure 1]

General formula (2)

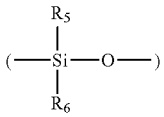

General formula (3)

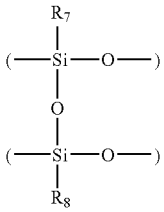

In general formulas (2) and (3), $R_5$-$R_8$ each represent a substituent selected from such as a methyl group, an ethyl group, a phenyl group, a vinyl group and a hydroxyl group. Specifically, as for a combination of $R_5$ and $R_6$, mixtures of a combination of a hydroxyl group and a methyl group, and a combination of a methyl group and a methyl group, are preferable with respect to adhesion. Further, by utilizing resin having this constitution, it is preferably possible to form a cross-linked coating film by employing a curing agent described below. Further, any of modification types such as alkyl modification, phenol modification and urethane modification can be utilized. The ratio of above-described general formula (2) to (3) is preferably 1/99-70/30 and more preferably 5/95-50/50.

Further, it is possible to adjust such as charging amount by addition of a silane coupling agent against silicone resin. To adjust the charging amount, silane coupling agent is added at 5-50 weight parts and preferably 7-45 weight parts, against 100 parts of silicone resin. When the addition amount is excessive, there caused a problem of decrease of hardness of resin, while, when the addition amount is too small, charge providing ability may be decreased, resulting in not achieving an object.

A silane coupling agent is preferably alkoxy silane provided with an amino group or an amine group at the end, and includes those represented by the following structures.

[Chemical Structure 2]

(1) $NH_2CH_2CH_2CH_2Si(OCH_3)_3$ (2) $NH_2CH_2CH_2CH_2Si(OCH_2CH_3)_3$ (3) $NH_2CH_2CH_2CH_2Si(CH_3)(OCH_3)_2$ (4) $CH_3CONHCH_2CH_2CH_2Si(OCH_3)_3$ (5) $NH_2CH_2CH_2NHCH_2CH_2CH_2Si(OCH_3)_3$ (6) $NH_2CH_2CH_2NHCH_2CH_2NHCH_2CH_2CH_2Si(OCH_3)_3$ (7) $(CH_3CH_2)_2NCH_2CH_2CH_2Si(OCH_2CH_3)_3$ (8) $(CH_3CH_2)_2NCH_2CH_2CH_2Si(OCH_3)_3$ (9) $(CH_3CH_2CH_2)_2NCH_2CH_2CH_2Si(OCH_3)_3$

-continued

(10) $(CH_3CH_2CH_2CH_2)_2NCH_2CH_2CH_2Si(OCH_3)_3$

(11) $C_6H_5NHCH_2CH_2CH_2Si(OCH_3)_3$

(12) $CH_3CH_2NHCH_2CH_2CH_2Si(OCH_2CH_3)_3$

(13) $CH_3CH_2CH_2CH_2NHCH_2CH_2CH_2Si(OCH_3)_3$

(14) $NH_2CH_2CH_2NHCH_2CH_2CH_2Si(CH_3)(OCH_3)_2$

Among silane coupling agents described above, preferable are those having an amine group at the end as represented by structures such as example compounds (1), (2), (3), (5) and (6). The reason is not clear, however, it is estimated that these silane coupling agents are easily incorporated into resin due to an effect of active hydrogen existing at the end, resulting in stabilization of charging characteristics. Further, by utilizing silane coupling agents having an amine group at the end, the number of a cross-linking point is increased to provide a more minute cross-linking structure.

Further, it is preferable to utilize a curing agent to provide resin with a cross-linked structure. Curing agents include oxime type curing agents having a structure represented by following general formula (4).

[Chemical Structure 3]

General formula (4)

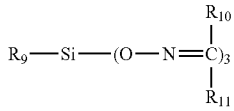

In general formula (4), $R_9$ represents a substituent selected from a group constituted of a methyl group, an ethyl group, a propyl group, a phenyl group and derivatives thereof, and $R_{10}$ and $R_{11}$ each represent a substituent selected from a group constituted of a methyl group, an ethyl group, a propyl group and derivatives thereof.

Specifically, listed are those having the following structures.

[Chemical Structure 4]

(15)

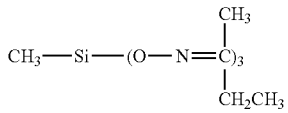

(16)

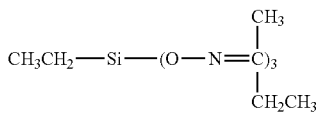

(17)

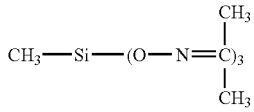

-continued (18)

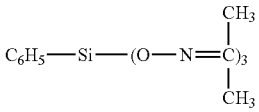

(19)

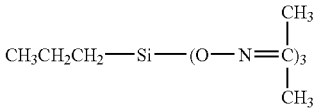

In this invention, an addition amount of the oxime type curing agent described above is 0.1-10 weigh parts and preferably 0.5-8 weight %, against 100 weight parts of resin. In the case of this addition amount range, it is possible to form a minute cross-linking structure, resulting in a minute coating film formation. In the case of an excess addition amount, cross-linking degree is lowered due to the remaining residue to decrease minuteness of a film, resulting in problems of deteriorated durability.

(Manufacturing Method of Carrier)

A carrier can be manufactured by providing plural times of coating of such as silicone resin and heating treatment on magnetic substance particles.

The coating method is not specifically limited, and a coating method such as an immersion method or a spray dry method is employed. Further, a heating treatment method is not also specifically limited and employed can be a dryer which heats and dries coated carrier while being held in such as a basket.

Plural times of coatings and heat treatments refers to repeat a process of silicone resin coating and heat treatment after magnetic substance particles having been coated with silicone type resin and heated. It is preferable to perform heating treatment each time to advance a cross-linking reaction. As for heating temperature, it is preferable to satisfy the following; 180° C.≦first time heating temperature ≦n-th time heating temperature ≦300° C. In the case of lower than 180° C., sufficient durability cannot be obtained due to generation of film abrasion because of insufficient progress of a cross-linking reaction, while film may be thermally deteriorated in the case of over 300° C., which is not preferable. Further, it is preferable that no low cross-linking components are formed by setting the heating temperature so as to satisfy the relation: first time heating temperature ≦n-th time heating temperature.

The resin coating amount of the first time coating is preferably set to 40-95 weight % of the total resin coating amount. On the other hand, the resin coating amount from the second time to the final time coating is preferably 5-60 weight % and more preferably 10-55 weight %, of the total resin coating amount. That is, when the resin coating amount is less than 5 weight %, the final coating cannot be made uniform to generate unevenness of the surface resin film, which is not preferable.

Plural time of coating is not problematic even when being performed several times, with respect to characteristics, however, since satisfactory characteristics can be obtained by two times coating, two times coating is preferred with respect to productivity.

An apparatus to apply a carrier with mechanical stress is not specifically limited, and utilized can be stirring mixers such as a Nauter mixer, a tabuler mixer, a V-type mixer and a W-corn type mixer. Since an apparatus such as a Nauter mixer which provides small striking energy per unit time takes a long time to prepare a carrier having satisfactory capabilities, it is preferable to utilize stirring mixers such as a tabuler mixer, a V-type mixer and a W-corn type mixer, which provide large striking energy per unit time.

A coating resin film thickness of silicone resin on magnetic substance particles is preferably 0.2-2.0 μm and more preferably 0.3-1.5 μm.

When the coating resin film thickness is over 2.0 μm, it is not preferable that image density is low and a good image cannot be obtained, while in the case of less than 0.2 μm, it is not preferable that sufficient durability cannot be obtained as well as a carrier becomes liable to adhere on an image forming substance surface due to injection of an electric charge from a development sleeve.

The coating resin film thickness is determined as an average value by cutting the center of a carrier particle and observing the cross-section through a scanning type electron microscope to extract several points randomly.

A coating resin amount of silicone resin on magnetic substance particles is preferably 0.3-15 weight % and more preferably 0.4-10 weight %, against magnetic substance particles. When the coating resin amount is less than 0.3 weight %, a uniform coating film cannot be formed on the magnetic substance particles, while in the case of over 15 weight %, the coating film becomes excessively thick to generate granulation of magnetic substance particles each other, resulting in non-uniform and poor fluid carrier-particles, which is not preferable. Further, when the coating resin amount is out of the preferable range, it is not preferable that a sufficient charging property and a rise characteristic of charging cannot be obtained.

The coating resin amount was measured by use of Carbon Analyzer "EMAIA-500" (manufactured by Horiba, Ltd.).

(Toner)

A toner is preferably comprised of colored particles, which contain binder resin, a colorant and other additives, and are mixed with inorganic particles. A volume average particle size (which means median diameter $D_{50}$ based on volume in this invention) is preferably 3-20 μm and more preferably 5-12 μm. A manufacturing method of colored particles is not specifically limited, and those prepared by a grinding method or a polymerization method can be utilized, however, preferable in this invention is a polymerization toner prepared by a polymerization method which can provide a characteristic of uniform particle size distribution. Herein, a polymerization toner means a toner which is formed by polymerization of starting material monomer of resin for a toner binder and appropriate chemical treatment thereafter. More specifically, it means a toner formed by a polymerization reaction, such as a suspension reaction and an emulsion polymerization, and appropriately via a fusion process of particles each other. A polymerization toner can provide a toner having uniform particle size distribution and uniform shape because the toner is manufactured by uniformly dispersing starting monomer in a water phase, followed by being polymerized.

As binder resin utilized for a toner is not specifically limited and conventionally well known various types of resin can be utilized. Specifically, listed are such as styrene type resin, acryl type resin, styrene/acryl type resin and polyester type resin. A colorant is not also specifically limited and conventionally well known materials can be utilized. Specifically, listed are such as carbon black, Nigrosin dye, aniline blue, chalcoine blue, chrome yellow, ultramarine blue, Dupont Oil Red, Quinoline Yellow, methylene blue chloride, Phthalocyanine Blue, Malachite Green Oxalate and Rose Bengale. Other additives include a charge controlling agent such as salicylic acid derivatives and azo type metal complexes and a fixing property improving agent such as low molecular weight polyolefin and Carnauba wax.

Further, in view of providing fluidity, inorganic microparticles are preferably mixed in colored particles. Inorganic particles are preferably made hydrophobic with such as a silane coupling agent or a titane coupling agent.

(Developer)

Developer can be prepared by mixing a toner and a carrier. The mixing ratio of a toner against a carrier is preferably 2-10 weight %.

An apparatus for the mixing is not specifically limited, and such as a Nauter mixer, a W-corn and a V-type mixer can be utilized.

Next, an organic photoreceptor according to the present invention will be explained.

Hereinafter, the structure of the organic photoreceptor will be explained.

The organic photoconductor refers to an electrophotographic photoconductor equipped with at least one of a charge generating function essential to the configuration of the electrophotographic photoconductor, and a charge transport function. It includes all the photoconductors composed of the commonly known organic charge generating substances or organic charge transfer substances, and the known organic photoconductors such as the photoconductor wherein the charge generating function and charge transfer function are provided by the high-molecular complex.

The structure of the photoreceptor according to the present invention has preferably a structure in which a charge generation layer and a charge transporting layer are laminated one by one as a lightsensitive layer on a conductive base support. Furthermore, it is desirable to prepare an intermediate layer between the conductive base support and a lightsensitive layer, and it may make it a structure in which a surface protecting layer is further formed on the lightsensitive layer as needed.

Hereinafter, a preferable concrete example of a later structure of an organic photoreceptor according to the present invention will be explained.

Conductive Support:

A sheet-like or cylindrical conductive support may be used as the conductive support for the photoconductor.

The cylindrical conductive support can be defined as a cylindrical support required forming images on an endless basis through rotation. The preferred cylindricity is 5 through 40 μm, and the more preferred one is 7 through 30 μm.

The cylindricity is based on the JIS (B0621-1984). To be more specific, when a cylindrical substrate is sandwiched between two coaxial geometrical cylinders, the cylindricity is expressed in terms of the difference of the radii at the position where a space between two coaxial cylinders is minimized. In the present invention, the difference in the radii is expressed in "μm". The cylindricity is gained by measuring the roundness at a total of seven points—two points 10 mm from both ends of the cylindrical substrate, a center, and four points obtained by dividing the space between both points and the center into three equal parts. A non-contact type universal roll diameter measuring instrument (by Mitsutoyo Co., Ltd.) can be used for this measurement.

The conductive support may include a metallic drum made of aluminum, nickel or the like, a plastic drum formed by vapor deposition of aluminum, tin oxide, indium oxide or the like, or a paper/plastic drum coated with conductive substance. The conductive support is preferred to have a specific resistance of $10^3$ Ωcm or less at the normal temperature.

A conductive support wherein the alumite film provided with porous sealing treatment on the surface is formed may be used. Alumite treatment is normally carried out in the acid bath containing a chromium oxide, sulfuric acid, oxalic acid, phosphoric acid, sulfamic acid or others. In sulfuric acid, the best result is obtained by anodization. In the case of anodization in sulfuric acid, preferred conditions include a sulfuric acid concentration of 100 through 200 g/l, aluminum ion concentration of 1 through 10 g/l, liquid temperature of around 20° C., and applied voltage of about 20 volts, without the preferred conditions being restricted thereto. The average thickness of the film formed by anodization is normally equal to or smaller than 20 μm, and is preferred to be equal to or smaller than 10 μm, in particular.

Intermediate Layer:

An intermediate layer equipped with barrier function can be provided between the conductive support and photosensitive layer.

The preferable intermediate layer contains N-type semiconductive fine particles. The N-type semiconductive fine particles refer to the ones that convert conductive carriers into electrons. Converting conductive carriers into electrons refers to the property of effectively blocking the hole injection from the substrate by containing the N-type semiconductive fine particles in the insulating binder, without blocking the electron from the photosensitive layer.

The following describes the method of identifying the N-type semiconductive particles.

An intermediate layer having a film thickness of 5 μm (intermediate layer formed by using a dispersion having 50 wt % of particles dispersed in the binder resin constituting the intermediate layer) is formed on the conductive support. This intermediate layer is negatively charged and the light damping property is evaluated. Further, it is positively charged, and the light damping property is evaluated in the same manner.

The N-type semiconductive particles are defined as the particles dispersed in the intermediate layer in cases where the light damping property, when negatively charged in the evaluation, is greater than that when positively charged.

The N-type semiconductive particles include the particles of titanium oxide ($TiO_2$), zinc oxide (ZnO) and tin oxide ($SnO_2$), and the titanium oxide is preferable.

The number average primary particle diameter is preferably 3.0 nm to 200 nm, more preferably 5 to 100 μm. The number average primary order particle size of the N type semi-conductive fine particles described above is obtained by the following. For example, the titanium oxide particles are magnified by a factor of 10,000 according to a transmission electron microscope, and one hundred particles are randomly selected as primary order particles from the magnified particles, and are obtained by measuring an average value of the FERE diameter according to image analysis. The intermediate layer using the N-type semiconductive particles where the number average primary particle diameter is within the aforementioned range permits dispersion in the layer to be made more compact, and is provided with sufficient potential stability and black spot preventive function.

The N-type semiconductive particles are configured in a branched, needle-shaped or granular form. These N-type semiconductive particles—for example, in the case of titanium oxide—are available in various crystal types such as anatase, rutile and amorphous type. Of these types, the rutile type titanium oxide pigment is particularly preferred since it enhances rectifying characteristics of charge through the intermediate layer, i.e., mobility of electron, whereby charge potential is stabilized and generation of transfer memory is prohibited as well as increase of residual potential is prohibited.

A hydrogenpolysiloxane compound is preferably used as the reactive organic silicon compound to be used in the last surface treatment of the N-type semiconductive particles. The hydrogenpolysiloxane having a molecular weight of from 1,000 to 20,000 is easily available and shows a suitable black spot inhibiting ability, and gives good half tone image.

The polymer containing a methylhydrogensilixane unit is preferably a copolymer of a structural unit of —(HSi($CH_3$)O)— and another siloxane unit. Preferable another siloxane unit is a dimethylsioxane unit, a methylethylsiloxane unit, a methylphenylsiloxane unit and a diethylsiloxane unit, and the dimethylsiloxane unit is particularly preferred. The ratio of the methylhydrogensiloxane unit in the copolymer is from 10 to 99 mole percent, and preferably from 20 to 90 mole percent.

The methylhydrogensiloxane copolymer is preferably a random copolymer or a block copolymer, even though a random copolymer, a lock copolymer and a graft copolymer are usable. The copolymerizing composition other than the methylhydrogensiloxane may be one or more kinds.

The N-type semiconductor particle may be one subjected to surface treatment by a reactive organic compound represented by the following formula.

$$(R)_n—Si—(X)_{4-n}$$

In the above, Si is a silicon atom, R is an organic group directly bonded by the carbon atom thereof to the silicone atom, X is a hydrolyzable group and n is an integer of 0 to 3.

In the organic silicone compound represented by the above formula, the organic group represented by R which is directly bonded by the carbon atom thereof to the silicone atom is, for example, an alkyl group such as a methyl group, an ethyl group, a propyl group, a butyl group, a pentyl group, a hexyl group, an octyl group and a dodecyl group; an aryl group such as a phenyl group, a tolyl group, a naphthyl group and a biphenyl group; an epoxy group-containing group such as a γ-glycidoxypropyl group and a β-(3,4-epoxycyclohexyl) ethyl group; a (metha)acryloyl group-containing group such as a γ-acryloxypropyl group and a γ-methacryloxypropyl group; a hydroxyl group-containing group such as a γ-hydroxypropyl group and a 2,3-dihydroxypropyloxypropyl group, a vinyl group-containing group such as a vinyl group and a propenyl group; a mercapto group-containing group such as a γ-mercaptopropyl group: an amino group-containing such as a γ-aminopropyl group and an N-β(aminoethyl)-γ-aminopropyl group; a halogen-containing group such as a γ-chloropropyl group, 1,1,1-trifluoropropyl group, a nonafluorohexyl group and a perfluoroctylethyl group; and a nitro group and a cyano-substituted alkyl group. Examples of the hydrolyzable group include an alkoxy group such as a methoxy group and an ethoxy group; a halogen atom and an acyloxy group.

The organic silicone compound represented by the foregoing may be employed singly or in combination of two or more kinds thereof.

In the compounds represented by the foregoing organic silicone compound, plural groups represented by R may be the same or different when n is 2 or more.

The N-type semiconductor particle may be subjected to a surface treatment by alumina or silica before the surface treatment by the methylhydrogensiloxane copolymer or the reactive organic silicone compound.

The treatment by alumina and that by silica may be performed simultaneously, and it is particularly preferable that the treatment by alumina is firstly carried out and then the treatment by silica is provided. The amount of silica is preferably larger than that of alumina when the treatments by alumina and silica are applied.

An intermediate layer coating liquid prepared for forming the intermediate layer is constituted by a binder and a dispersing solvent additional to the surface-treated N-type semiconductor particles.

The ratio of the N-type semiconductor particles to the binder resin in the intermediate layer is preferably from 1.0 to 2.0 times of the binder resin in the volume ratio. By employing the N-type semiconductor particles in such the high density in the intermediate layer, a rectifying ability of the intermediate layer is increased so that the increasing of the remaining potential and the transfer memory are not caused even when the thickness of the layer is increased, the black spots can be effectively prevented and the suitable organic photoreceptor with small potential fluctuation can be prepared. In the intermediate layer, 100 to 200 parts by volume of the N-type semiconductor particles are preferably employed to 100 parts by volume the binder resin.

As the binder for dispersing the particles and forming the interlayer, polyamide resins are preferable for obtaining good dispersing state, the following polyamide resins are particularly preferred.

Polyamide resins each having a heat of fusion of from 0 to 40 J/g and a water absorption degree of not more than 5% are preferable for the binder of the interlayer. The heat of fusion of the resin is preferably from 0 to 30 J/g, and most preferably from 0 to 20 J/g. By such the polyamide resins, the moisture content is suitably kept, and the occurrence of the dielectric breakdown and the black spot, increasing of the remaining potential and the formation of fog are inhibited. Accordingly, the water absorption degree is more preferably not more than 4%.

The heat of fusion of the resin is measured by differential scanning calorimetry (DSC). Another method may be utilized as long as a result the same as that obtained by DSC can be obtained. The heat of fusion is obtained from the area of endothermic peak in the course of temperature rising in the DSC measurement.

The water absorption degree of the resin is measured by the weight variation by a water immersion method or Karl-Fischer's method.

As the binder resin of the interlayer, a resin superior in the solubility in solvent is necessary for forming the interlayer having a uniform layer thickness. Alcohol-soluble polyamide resins are preferable for the binder resin of the interlayer. As such the alcohol-soluble polyamide resin, copolymerized polyamide resins having a short carbon chain between the amide bond such as 6-Nylon and methoxymethylized polyamide resins have been known. These resins have high water absorption degree, and the interlayer employing such the polyamide tends to have high dependency on the environmental condition. Consequently, the sensitivity and the charge property are easily varied under high temperature and high humidity or low temperature and low humidity condition, and the dielectric breakdown and the black spots occur easily.

In the invention, the alcohol-soluble polyamide resins having a heat of fusion of from 0 to 40 J/g and a water absorption degree of not more than 5% by weight are employed to improve such the shortcoming of the usual alcohol-soluble polyamide resin. Thus good electrophotographic image can be obtained even when the exterior environmental conditions are changed and the electrophotographic photoreceptor is continuously used for a prolonged period.

The alcohol-soluble polyamide resin having a heat of fusion of from 0 to 40 J/g and a water absorption degree of not more than 5% by weight is described below.

It is preferable that the alcohol-soluble polyamide resins contains structural repeating units each having a number of carbon atoms between the amide bonding of from 7 to 30 in a ratio of from 40 to 100 Mole % of the entire repeating units.

The repeating unit means an amide bonding unit constituting the polyamide resin. Such the matter is described below referring the an examples of polyamide resin (Type A) in which the repeating unit is formed by condensation of compounds each having both of an amino group and a carboxylic acid group and examples of the polyamide resin (Type B) in which the repeating unit is formed by condensation of a diamino compound and a di-carboxylic acid compound.

The repeating unit structure of Type A is represented by Formula 5, in which the number of carbon atoms included in X is the carbon number of the amide bond unit in the repeating unit. The repeating unit structure of Type B is represented by Formula 6, in which both of the number of carbon atoms included in Y and that included in Z are each the number of carbon atoms of the amide bond in the repeating unit structure.

Formula 5

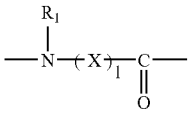

In the above, $R_1$ is a hydrogen atom or a substituted or unsubstituted alkyl group; X is an alkylene group, a group containing di-valent cycloalkane group or a group having mixed structure of the above; the above groups represented by X may have a substituent; and 1 is a natural number.

Formula 6

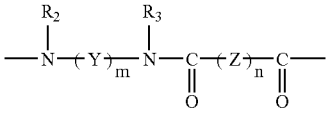

$R_2$ and $R_3$ are each a hydrogen atom, a substituted or unsubstituted alkyl group; Y and Z are each an alkylene group, a group containing a di-valent cycloalkane group or a group having mixed structure of the above, the above groups represented by Y and Z each may have a substituent; and m and n are each a natural number.

Examples of the structure of repeating unit having carbon atoms of from 7 to 30 are a substituted or unsubstituted alkylene group, an alkylene group, a group containing a di-valent cycloalkane group or a group having mixed structure of the above, and the above groups represented by Y and Z each may have a substituent. Among them the structures having the di-valent cycloalkane groups are preferred.

In the polyamide resin to be used in the invention, the number of the carbon atoms between the amide bonds of the repeating unit structure is from 7 to 30 for inhibiting the hygroscopic property of the polyamide resin so that the photographic properties, particularly the humidity dependency of the potential on the occasion of the repeating use is made small and the occurrence of the image defects such as the black spots is inhibited without lowering of the solubility of the resin in the solvent for coating. The carbon number is preferably from 9 to 25, more preferably from 11 to 20. The ratio of the structural repeating unit having from 7 to 30 between the amide bonds to the entire repeating units is from 40 to 100 mole-percent, preferably from 60 to 100 mole-percent, and further preferably from 80 to 100 mole-percent.

Number of carbon atoms of polyamide is preferably 7-30, since such polyamide has adequate hygroscopicity and good solubility in solvent for coating composition.

Polyamide resins having a repeating unit structure represented by Formula 7 are preferred.

Formula 7

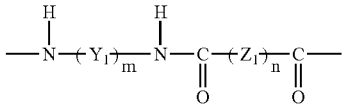

In the above, $Y_1$ is a di-valent group containing an alkyl-substituted cycloalkane group, $Z_1$ is a methylene group, m is an integer of from 1 to 3 and n is an integer of 3 to 20.

The polyamide resins in which the group represented by $Y_1$ is the group represented by the following formula are preferable since such the polyamide resins display considerable improving effect on the black spot occurrence.

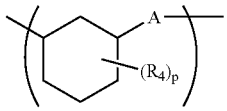

In the above, A is a simple bond or an alkylene group having from 1 to 4 carbon atoms; $R_4$ is an alkyl group; and p is a natural number of from 1 to 5. Plural $R_4$ may be the same as or different from each other.

Concrete examples of the polyamide resin are shown below.

N-1

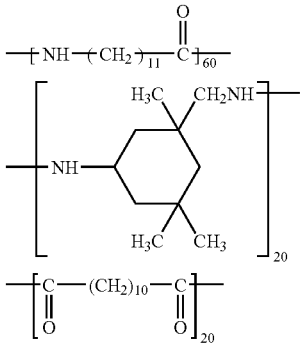

(100%)

N-2

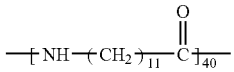

-continued
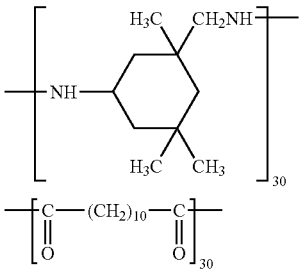
(100%)
N-3
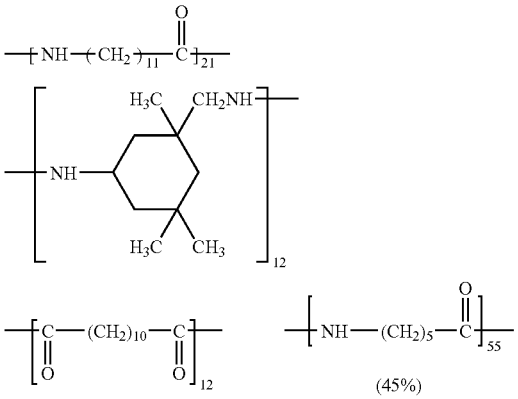
(45%)
N-4
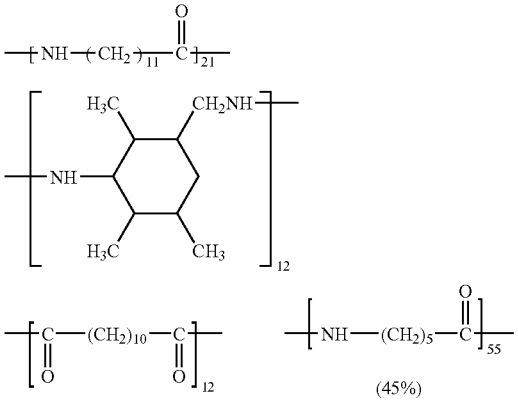
(45%)
N-5
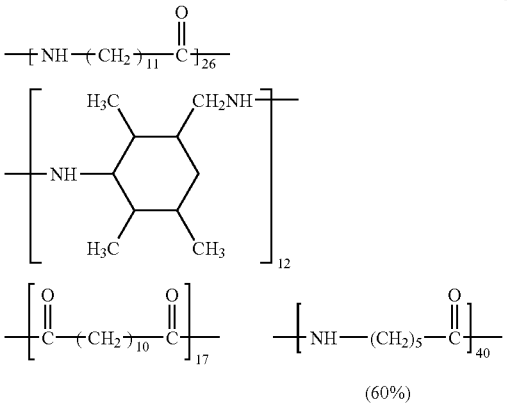
(60%)
N-6
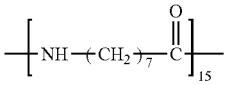
-continued
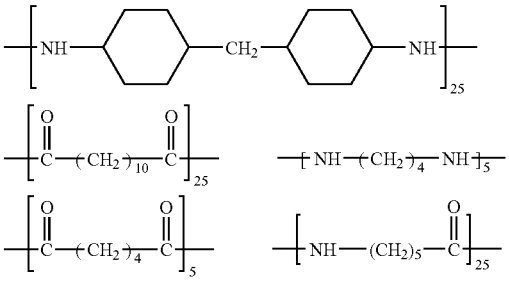
(65%)
N-7
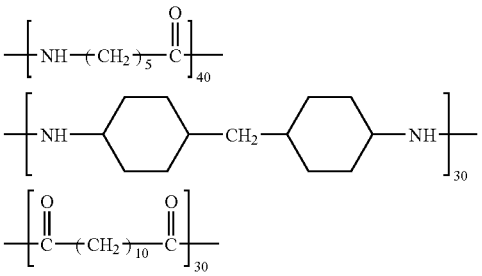
(60%)
N-8
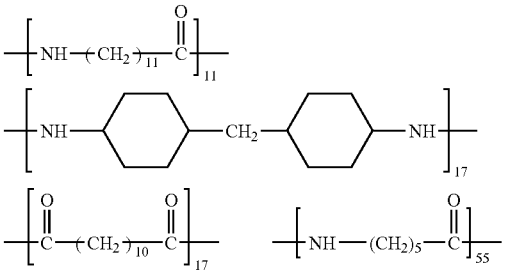
(45%)
N-9
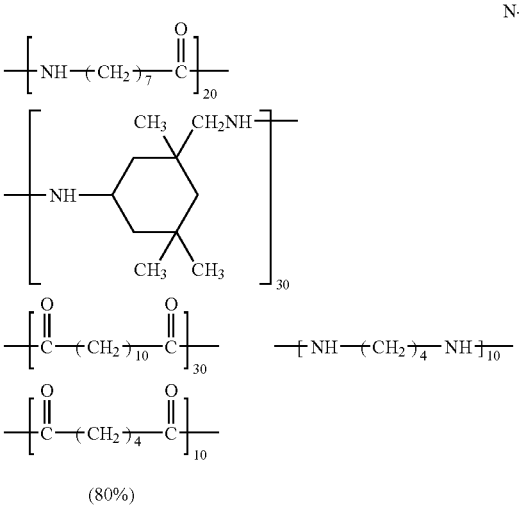
(80%)
N-10
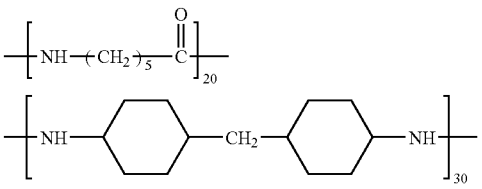

-continued

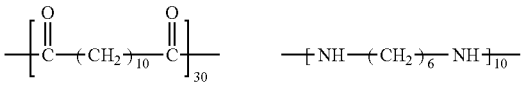

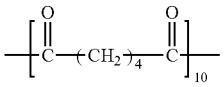

(60%)

N-11

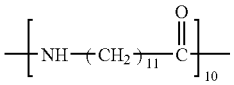

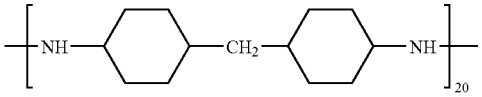

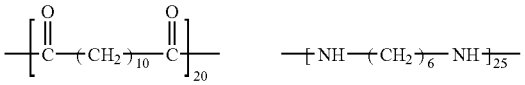

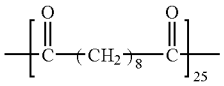

(75%)

In the above concrete examples, percentage shown in the parentheses represents the ratio in terms of mole-% of the repeating units having the 7 or more atoms between the amide bonds.

Among the above examples, the polyamide resins of N-1 through N-4 having the repeating unit represented by Formula 7 are particularly preferred.

The molecular weight of the polyamide resins is preferably from 5,000 to 80,000, more preferably from 10,000 to 60,000, in terms of number average molecular weight, because the uniformity of the thickness of the coated layer is satisfactory and the effects of the invention are sufficiently realized, and the solubility of the resin in the solvent is suitable, formation the coagulates of the resin in the interlayer and the occurrence of the image defects such as the black spots are inhibited.

The polyamide resin, for example, VESTAMELT X1010 and X4685, manufactured by Daicel.Degussa Ltd., are available in the market, and it is easy to prepare in a usual method. An example of the synthesis method is described.

As the solvent for preparing the coating liquid, alcohols having 2 through 4 carbon atoms such as ethanol, n-propyl alcohol, iso-propyl alcohol, n-butanol, t-butanol and sec-butanol are preferable from the viewpoint of the solubility of the polyamide resin and the coating suitability of the prepared coating liquid. These solvents are employed in a ratio of from 30 to 100%, preferably from 40 to 100%, and further preferably from 50 to 100%, by weight of the entire solvent amount. As solvent aid giving preferable effects when it is used together with the foregoing solvents, methanol, benzyl alcohol, toluene, methylene chloride, cyclohexanone and tetrahydrofuran are preferable.

Thickness of the interlayer is preferably 0.3-10 μM, and more preferably 0.5-5 μm, in view of minimized generation of black spots and non-uniform image at half tone area, inhibiting increase of residual potential and generation of transfer memory, whereby good image having high sharpness can be obtained.

The interlayer is substantially an insulation layer. The volume resistivity of the insulation layer is not less than $1\times10^{8}$ Ω·cm. The volume resistivity of the interlayer and the protective layer is preferably from $1\times10^{8}$ to $1\times10^{15}$ Ω·cm, more preferably from $1\times10^{9}$ to $1\times10^{14}$ Ω·cm, and further preferably from $2\times10^{9}$ to $1\times10^{13}$ Ω·cm. The volume resistivity can be measured as follows. Measuring condition: According to JIS C2318-1975

Measuring apparatus: Hiresta IP manufactured by Mitsubishi Chemical Corporation.

Measuring condition: Measuring prove HRS

Applied voltage: 500 V

Measuring environment: 30±2° C., 80±5% RH

Lightsensitive layer

Charge generating layer

As electric charge generating substance for the organic photoreceptor according to the present invention, it is desirable to use an electric charge generating substance which has high sensitiveness characteristics to a wavelength region of 350 nm-500 nm. As such electric charge generating substance, pigments, such as a following condensation multi-ring system compound, may be used preferably. Moreover, these pigments can be used in combination.

As electric charge generating substance of the condensation multi-ring system compound, a multi-ring quinone pigment compound represented by a general formula (8) to general formula (10) and a perylene pigment compound represented by a general formula (11) to a general formula (13) and a general formula (14) may be desirable.

For exposure light whose wavelength is 350-500 nm, these pigment compounds have a large potential damping value over a unit exposure amount so that these pigment compounds can form a dot latent image of a small size sharply.

General formulas (8)

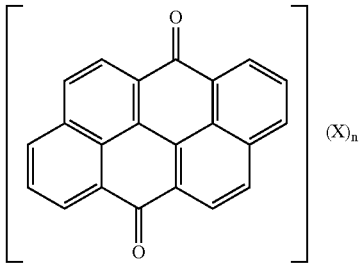

-continued
General formulas (9)
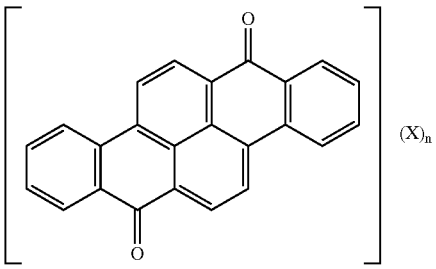
General formulas (10)
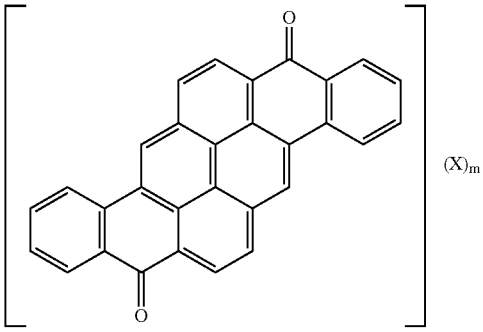
(In the general formulas (8), (9) and (10), X represents a halogen atom, an alkyl group, a nitro group, a cyano group, an acyl group, or a carboxyl group, n represents an integer of 0 to 4 and m represents an integer of 0 to 6.)
CG1-1
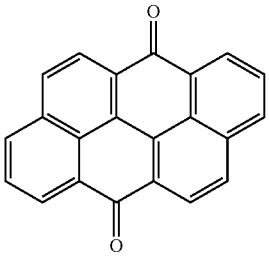
CG1-2
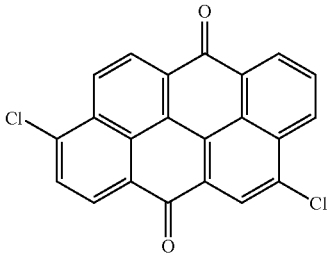
CG1-3
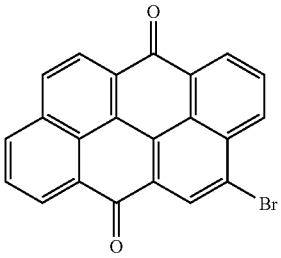
-continued
CG1-4
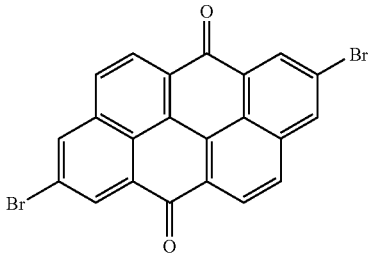
CG1-5
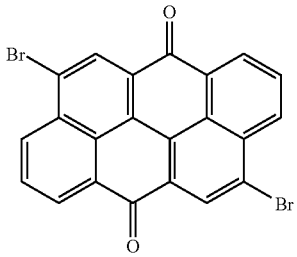
CG1-6
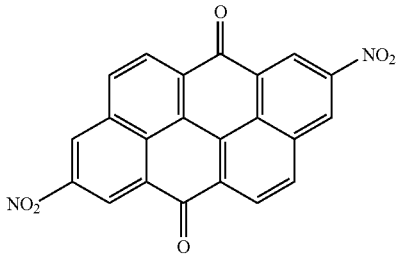
CG1-7
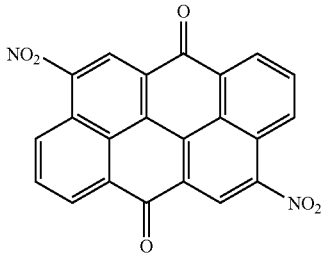
CG1-8
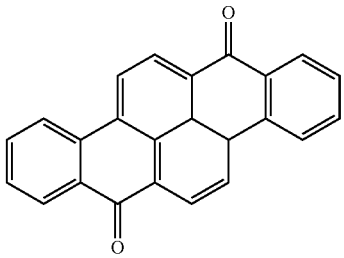
CG1-9
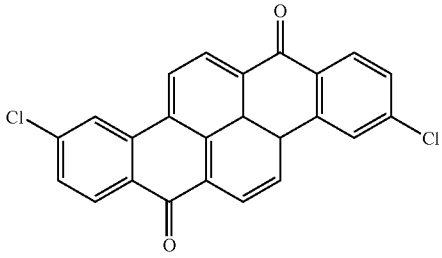

-continued
CG1-10
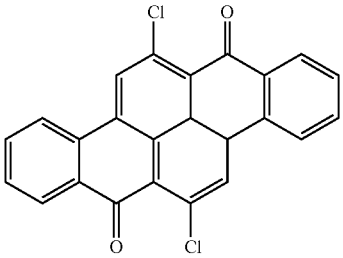
CG1-11
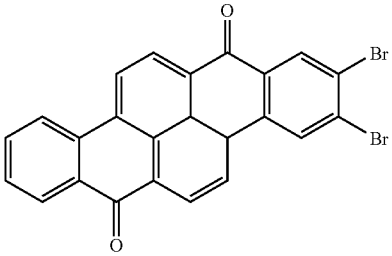
CG1-12
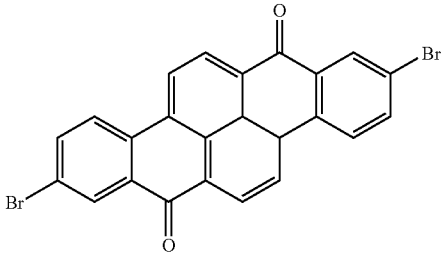
CG1-13
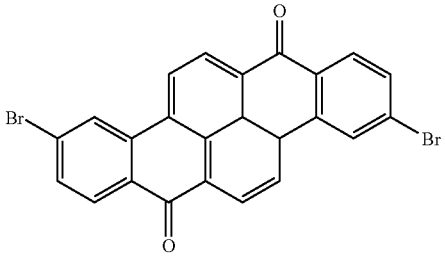
CG1-14
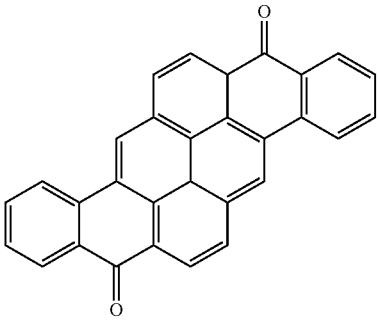
-continued
CG1-15
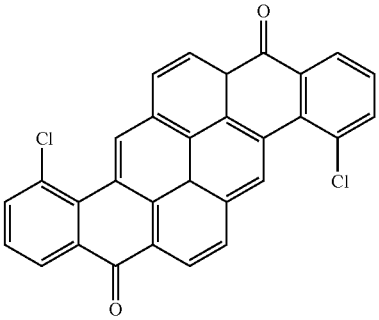
CG1-16
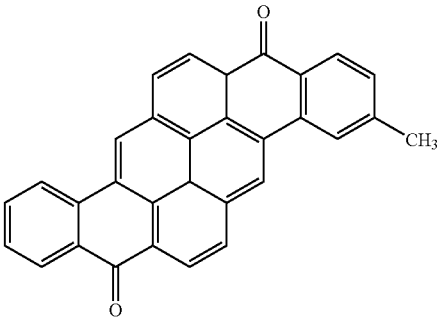
CG1-17
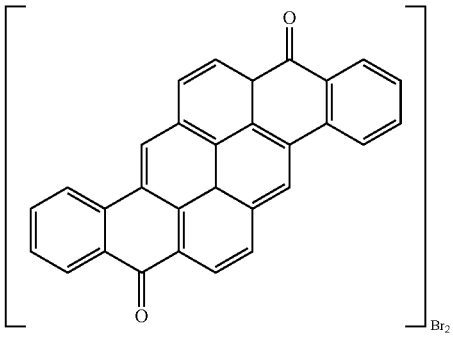
CG1-18
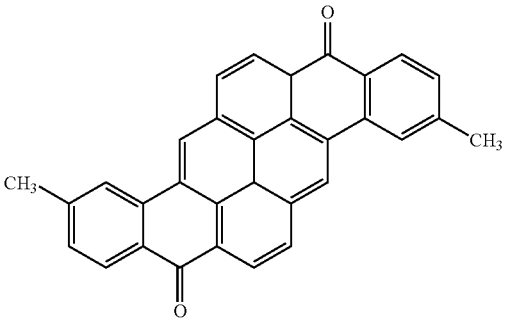

-continued

General formula (11)

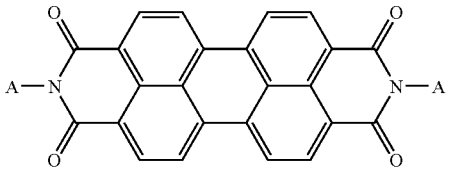

General formula (12)

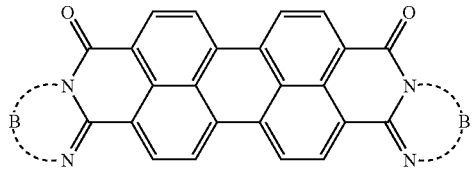

-continued

General formula (13)

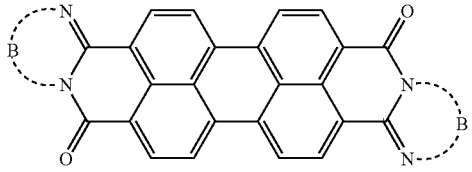

(In the general formulas (11), (12) and (13), A represents a hydrogen atom, an alkyl group, an alkoxy group or an aromatic hydrocarbon group that may be substituted, and B represents a bivalent aromatic hydrocarbon group which B may be substituted, or a bivalent nitrogen-containing heterocyclic group.)

The example of the perylene pigment compound of the general formula (11) to the general formula (13) is exemplified below.

CG2-1

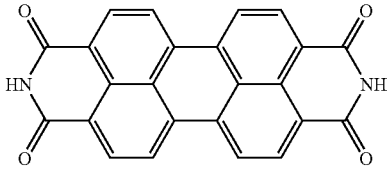

CG2-2

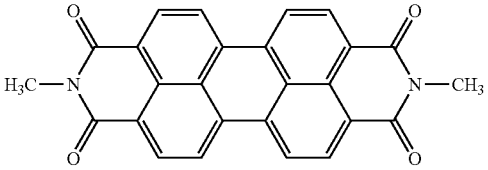

CG2-3

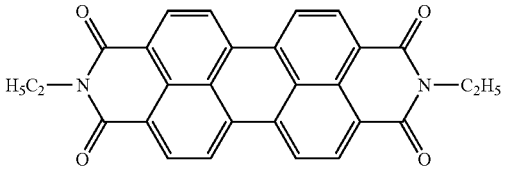

CG2-4

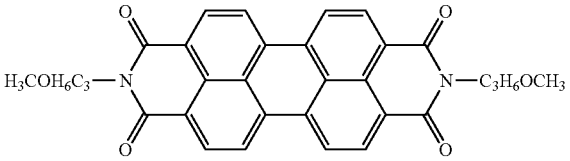

CG2-5

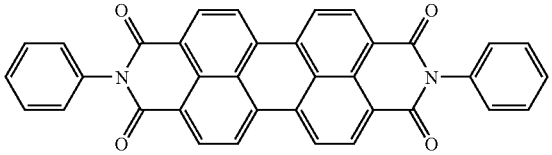

CG2-6

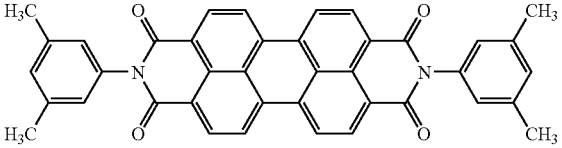

CG2-7

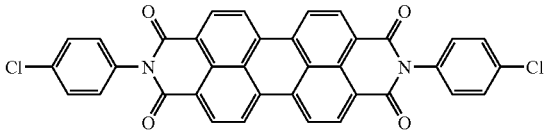

CG2-8

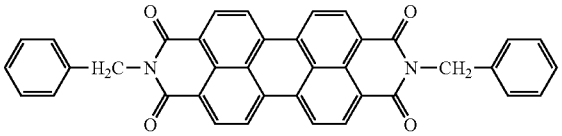

CG2-9

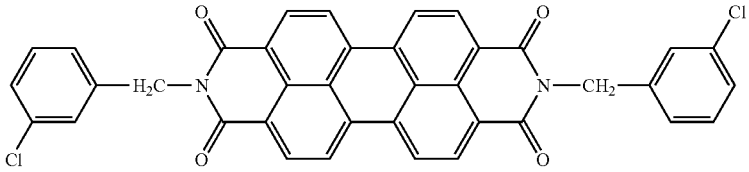

CG2-10

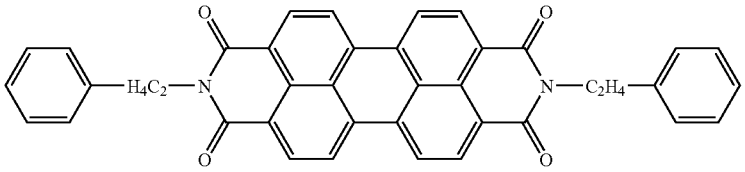

-continued

CG2-11

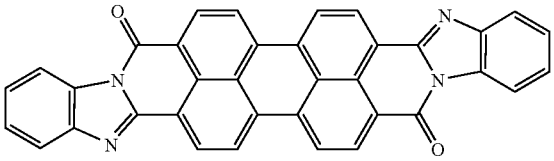

CG2-12

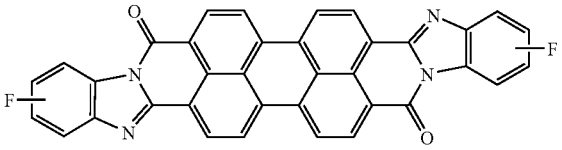

CG2-13

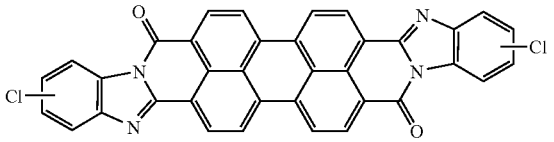

CG2-14

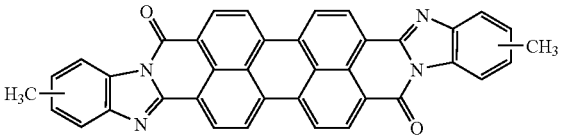

CG2-15

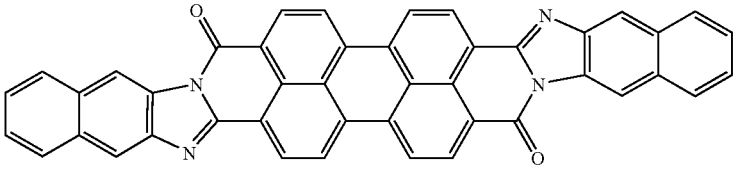

CG2-16

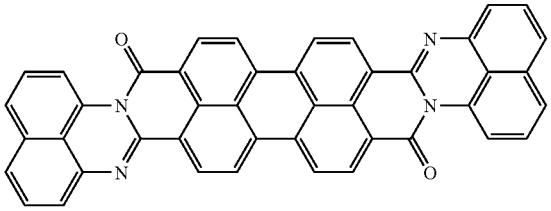

CG2-17

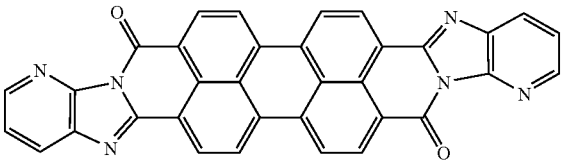

General formula (14)

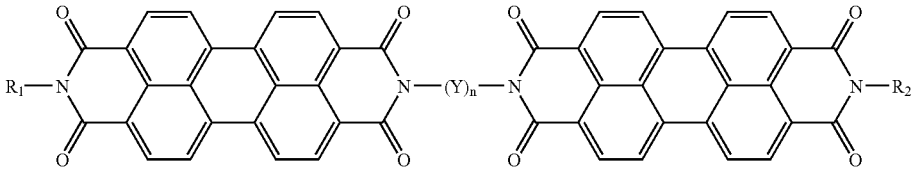

(In a general formula (14), $R_1$ and $R_2$ are hydrogen or a substituted or unsubstituted alkyls, and R1 and R2 may be the same, or may different from each other. Moreover, Y is a bridging part at the time of n=1, is a substituted or unsubstituted alkylene, and is a direct combination of N—N at the time of n=0.)

The example of the perylene pigment compound of the general formula (14) is exemplified below.

CG3-1

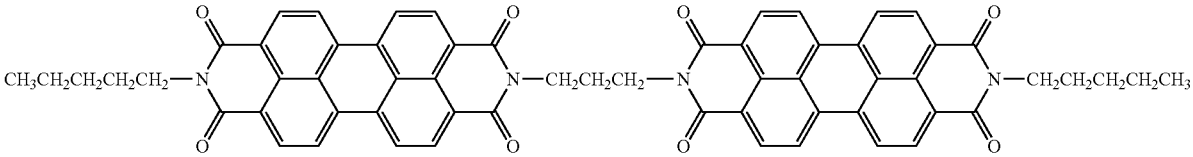

CG3-2

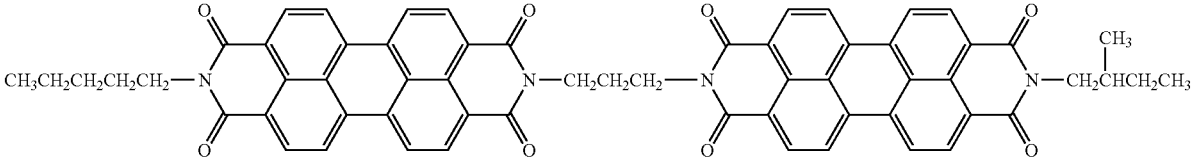

-continued

CG3-3

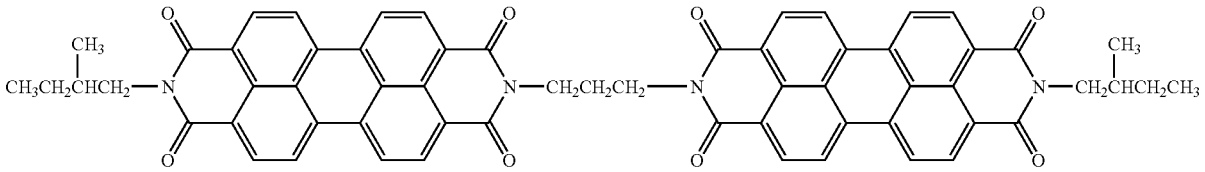

In case of using a binder as a dispersing medium of a CGM in the charge generating layer, a known resin can be employed for the binder, and the most preferable resins are butyral resin, silicone resin, silicone modification butyral resin, phenoxy resin. The ratio between the binder resin and the charge generating material is preferably binder resin 100 weight part for charge generating material 20 to 600 weight part. Increase in residual electric potential with repeated use can be minimized by using these resins. The layer thickness of the charge generating layer is preferably in the range of 0.3 to 2 mm.

Charge Transporting Layer

A charge transporting layer contains a charge transporting material (CTM) and a binder resin for dispersing the CTM and forming a layer. As the other materials, the charge transporting layer may contain additives such as an antioxidant agent if necessary.

As a charge transporting material (CTM), a compound which has a high electric charge transportation ability and a small absorption for a laser light in a region of 350-500 nm is desirable. As such a compound, a compound represented by a general formula (15) to a general formula (18) may be desirable.

General formula (15)

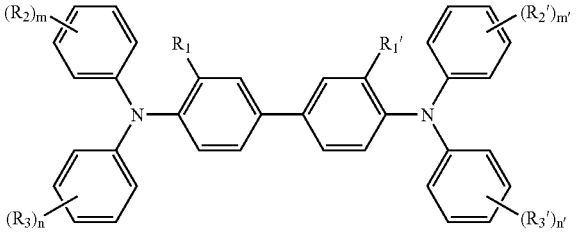

(In the general formula (15), $R_1$ and $R_{1'}$ represent a hydrogen atom, an alkyl group, an alkoxy group, or a halogen atom respectively, $R_2$, $R_{2'}$, $R_3$, and $R_{3'}$ represent a hydrogen atom, an alkyl group, an alkoxy group, a halogen atom, or a substitution amino group respectively, and m, m', n, and n' means an integer of 1 or 2, respectively.)

Below, the example of the compound of the general formula (15) is shown.

| Compound No. | $R_1$,$R_1$' | $R_2$,$R_2$' | $R_3$,$R_3$' |
|---|---|---|---|
| CT1-1 | $CH_3$ | H | H |
| CT1-2 | $CH_3$ | 2-$CH_3$ | H |
| CT1-3 | $CH_3$ | 3-$CH_3$ | H |
| CT1-4 | $CH_3$ | 4-$CH_3$ | H |
| CT1-5 | $CH_3$ | 4-$CH_3$ | 2-$CH_3$ |
| CT1-6 | $CH_3$ | 4-$CH_3$ | 3-$CH_3$ |

-continued

| Compound No. | $R_1$,$R_1$' | $R_2$,$R_2$' | $R_3$,$R_3$' |
|---|---|---|---|
| CT1-7 | $CH_3$ | 4-$CH_3$ | 4-$CH_3$ |
| CT1-8 | $CH_3$ | 3,4-$CH_3$ | H |
| CT1-9 | $CH_3$ | 3,4-$CH_3$ | 3,4-$CH_3$ |
| CT1-10 | $CH_3$ | 4-$C_2H_5$ | H |
| CT1-11 | $CH_3$ | 4-$C_3H_7$ | H |
| CT1-12 | $CH_3$ | 4-$C_4H_9$ | H |
| CT1-13 | $CH_3$ | 4-$C_2H_5$ | 2-$CH_3$ |
| CT1-14 | $CH_3$ | 4-$C_2H_5$ | 3-$CH_3$ |
| CT1-15 | $CH_3$ | 4-$C_2H_5$ | 4-$CH_3$ |
| CT1-16 | $CH_3$ | 4-$C_2H_5$ | 3,4-$CH_3$ |
| CT1-17 | $CH_3$ | 4-$C_3H_7$ | 3-$CH_3$ |
| CT1-18 | $CH_3$ | 4-$C_3H_7$ | 4-$CH_3$ |
| CT1-19 | $CH_3$ | 4-$C_4H_9$ | 3-$CH_3$ |
| CT1-20 | $CH_3$ | 4-$C_4H_9$ | 4-$CH_3$ |
| CT1-21 | $CH_3$ | 4-$C_2H_5$ | 4-$C_2H_5$ |
| CT1-22 | $CH_3$ | 4-$C_2H_5$ | 4-$OCH_3$ |
| CT1-23 | $CH_3$ | 4-$C_3H_7$ | 4-$C_3H_7$ |
| CT1-24 | $CH_3$ | 4-$C_3H_7$ | 4-$OCH_3$ |
| CT1-25 | $CH_3$ | 4-$C_4H_9$ | 4-$C_4H_9$ |
| CT1-26 | $CH_3$ | 4-$C_4H_9$ | 4-$OCH_3$ |
| CT1-27 | H | 3-$CH_3$ | H |
| CT1-28 | Cl | H | H |
| CT1-29 | Cl | 2-$CH_3$ | H |
| CT1-30 | Cl | 3-$CH_3$ | H |
| CT1-31 | Cl | 4-$CH_3$ | H |
| CT1-32 | Cl | 4-$CH_3$ | 2-$CH_3$ |
| CT1-33 | Cl | 4-$CH_3$ | 3-$CH_3$ |
| CT1-34 | Cl | 4-$CH_3$ | 4-$CH_3$ |
| CT1-35 | $C_2H_5$ | H | H |
| CT1-36 | $C_2H_5$ | 2-$CH_3$ | H |
| CT1-37 | $C_2H_5$ | 3-$CH_3$ | H |
| CT1-38 | $C_2H_5$ | 4-$CH_3$ | H |
| CT1-39 | $C_2H_5$ | 4-$CH_3$ | 4-$CH_3$ |
| CT1-40 | $C_2H_5$ | 4-$C_2H_5$ | 4-$CH_3$ |
| CT1-41 | $C_2H_5$ | 4-$C_3H_7$ | 4-$CH_3$ |
| CT1-42 | $C_2H_5$ | 4-$C_4H_9$ | 4-$CH_3$ |
| CT1-43 | $OCH_3$ | H | H |
| CT1-44 | $OCH_3$ | 2-$CH_3$ | H |
| CT1-45 | $OCH_3$ | 3-$CH_3$ | H |
| CT1-46 | $OCH_3$ | 4-$CH_3$ | H |
| CT1-47 | $OCH_3$ | 4-$CH_3$ | 4-$CH_3$ |
| CT1-48 | $OCH_3$ | 4-$C_2H_5$ | 4-$CH_3$ |
| CT1-49 | $OCH_3$ | 4-$C_3H_7$ | 4-$CH_3$ |
| CT1-50 | $OCH_3$ | 4-$C_4H_9$ | 4-$CH_3$ |
| CT1-51 | $CH_3$ | 2-$N(CH_3)_2$ | H |
| CT1-52 | $CH_3$ | 3-$N(CH_3)_2$ | H |
| CT1-53 | $CH_3$ | 4-$N(CH_3)_2$ | H |
| CT1-54 | $CH_3$ | 4-Cl | H |

General formula (16)

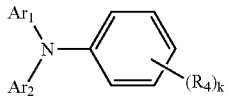

(In the general formula (16), $R_4$ represents a hydrogen atom or a methyl group, $A_{r1}$ and $A_{r2}$ represent a halogen atom, an alkyl group, an aryl group or a thienyl group which may have an alkoxy group, or a substituted amino group, respectively and k means an integer of 1 or 2.)

Below, an example of a compound of the general formula (16) is shown.

| | | | |
|---|---|---|---|
| CT2-1<br>CT2-2 | 4-$CH_3$<br>3-$CH_3$,4-$CH_3$ | 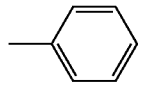 | 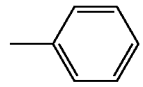 |
| CT2-3<br>CT2-4 | 4-$CH_3$<br>3-$CH_3$,4-$CH_3$ | 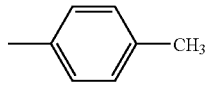 | 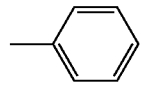 |
| CT2-5<br>CT2-6 | 4-$CH_3$<br>3-$CH_3$,4-$CH_3$ | 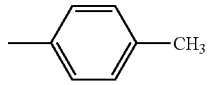 | 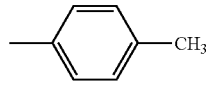 |
| CT2-7<br>CT2-8 | 4-$CH_3$<br>3-$CH_3$,4-$CH_3$ | 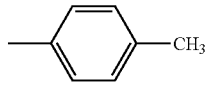 | 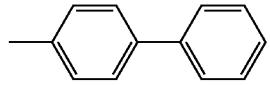 |
| CT2-9<br>CT2-10 | 4-$CH_3$<br>3-$CH_3$,4-$CH_3$ | 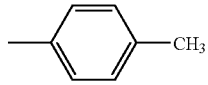 | 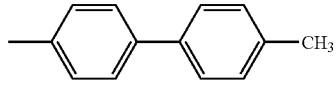 |
| CT2-11<br>CT2-12 | 4-$CH_3$<br>3-$CH_3$,4-$CH_3$ | 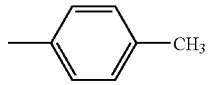 | 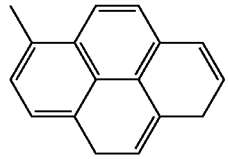 |
| CT2-13<br>CT2-14 | 4-$CH_3$<br>3-$CH_3$,4-$CH_3$ | 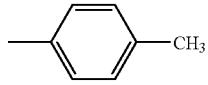 | 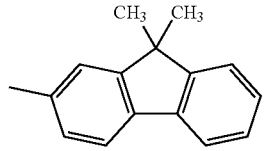 |
| CT2-15<br>CT2-16 | 4-$CH_3$<br>3-$CH_3$,4-$CH_3$ | 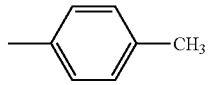 | 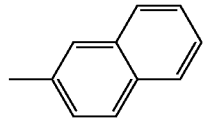 |
| CT2-17<br>CT2-18 | 4-$CH_3$<br>3-$CH_3$,4-$CH_3$ | 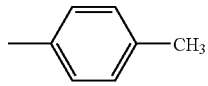 | 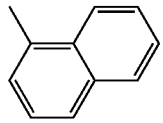 |
| CT2-19<br>CT2-20 | 4-$CH_3$<br>3-$CH_3$,4-$CH_3$ | 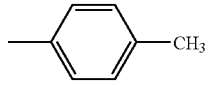 | 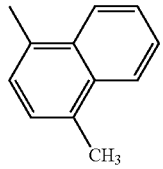 |

| | $R_4$ | $Ar_1$ | $Ar_2$ |
|---|---|---|---|
| CT2-21<br>CT2-22 | 4-$CH_3$<br>3-$CH_3$,4-$CH_3$ | 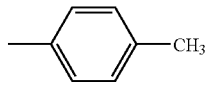 | 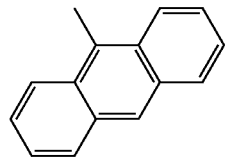 |

-continued

| | | | |
|---|---|---|---|
| CT2-23<br>CT2-24 | 4-$CH_3$<br>3-$CH_3$,4-$CH_3$ | 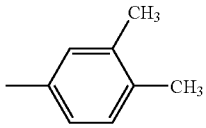 | 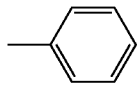 |
| CT2-25<br>CT2-26 | 4-$CH_3$<br>3-$CH_3$,4-$CH_3$ | 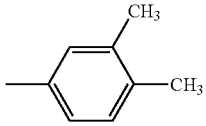 | 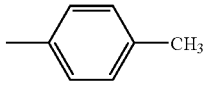 |
| CT2-27<br>CT2-28 | 4-$CH_3$<br>3-$CH_3$,4-$CH_3$ | 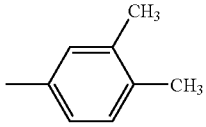 | 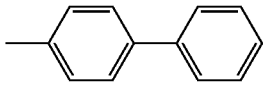 |
| CT2-29<br>CT2-30 | 4-$CH_3$<br>3-$CH_3$,4-$CH_3$ | 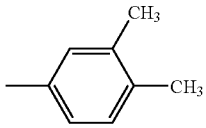 | 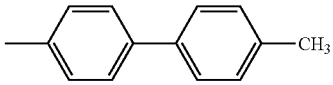 |
| CT2-31<br>CT2-32 | 4-$CH_3$<br>3-$CH_3$,4-$CH_3$ | 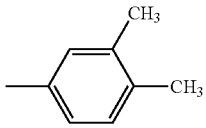 | 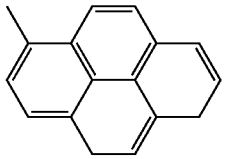 |
| CT2-33<br>CT2-34 | 4-$CH_3$<br>3-$CH_3$,4-$CH_3$ | 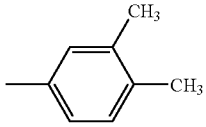 | 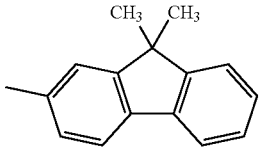 |
| CT2-35 | 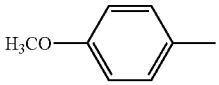 | 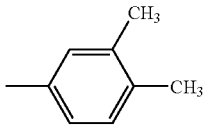 | 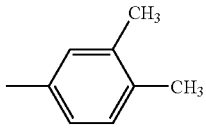 |

General formula (17)

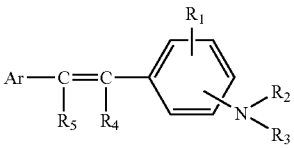

(In the general formula (17), $R_1$ represents a hydrogen atom, an alkyl group, an alkoxy group, or a halogen atom, $R_2$ and $R_3$ represent an alkyl group, a substituted or unsubstituted aralkyl group, or a substituted or unsubstituted aryl group, and R2 and R3 may be the same, or may be different from each other. $R_4$ and $R_5$ represents a hydrogen atom, a low-grade alkyl group, or a substituted or unsubstituted aryl group, and Ar represents a substituted aryl group, Ar and R5 may combine to form a ring.

Below, an example of a compound of the general formula (17) is shown.

CT3-1

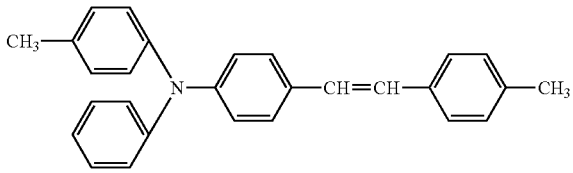

CT3-2

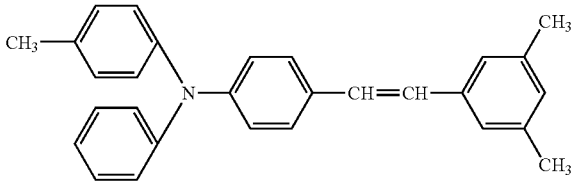

-continued
CT3-3
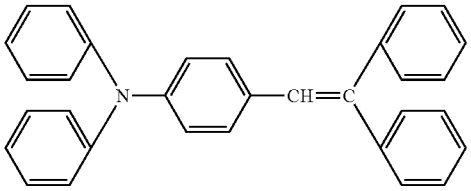
CT3-4
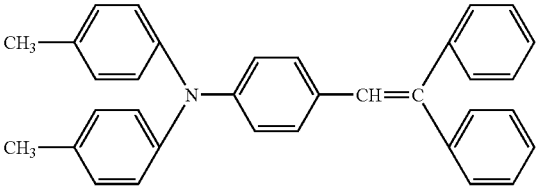
CT3-5
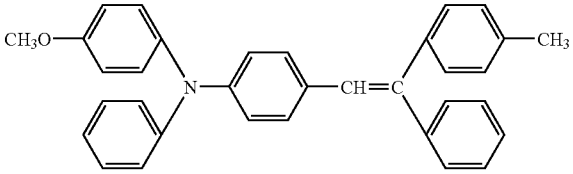
CT3-6
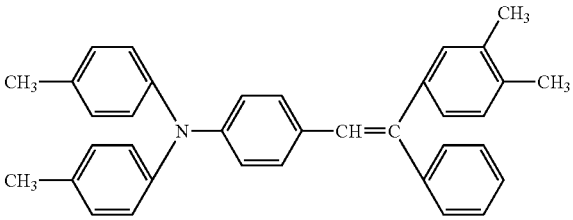
CT3-7
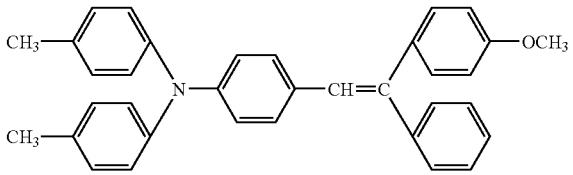
CT3-8
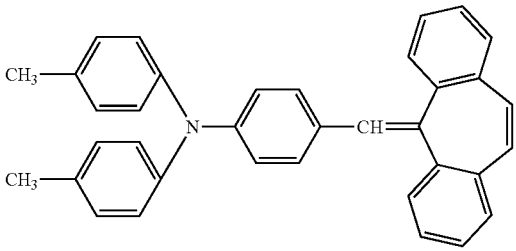
CT3-9
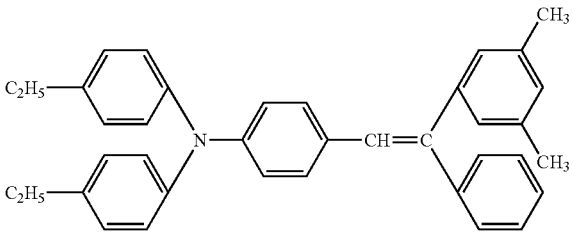
-continued
CT3-10
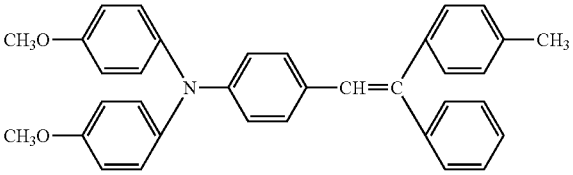
CT3-11
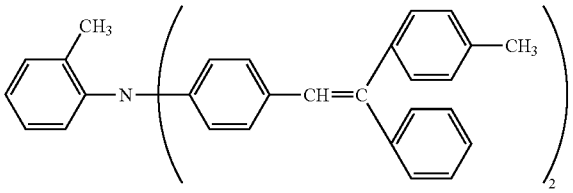
CT3-12
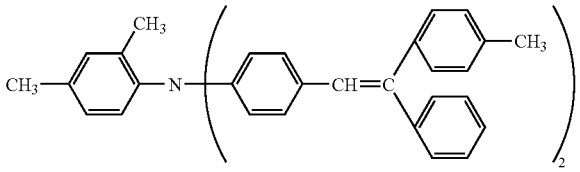
CT3-13
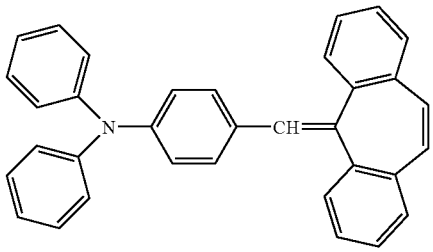
CT3-14
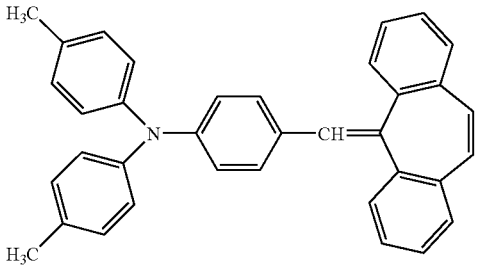
CT3-15
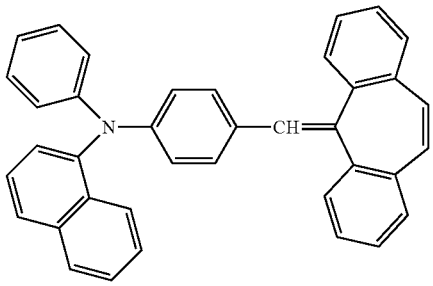

-continued

CT3-16

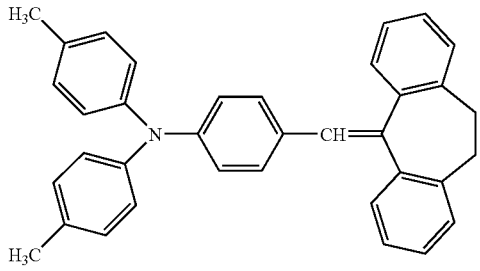

CT3-17

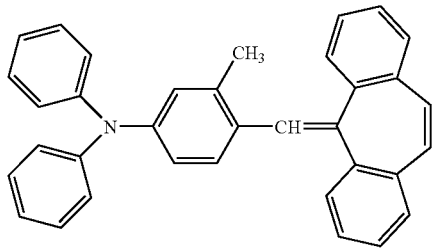

General formula (18)

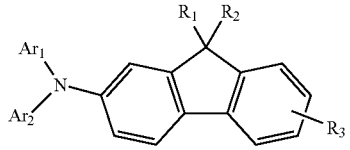

(In the general formula (18), $A_{r1}$ and $A_{r2}$ represent a substituted or unsubstituted aromatic ring group, $R_1$ and $R_2$ represent a hydrogen atom or an alkyl group, and $R_3$ represents a hydrogen atom, an alkyl group, or a halogen atom.)

Below, an example of a compound of the general formula (18) is shown.

CT4-1

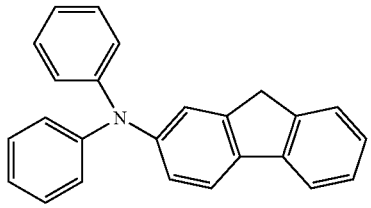

CT4-2

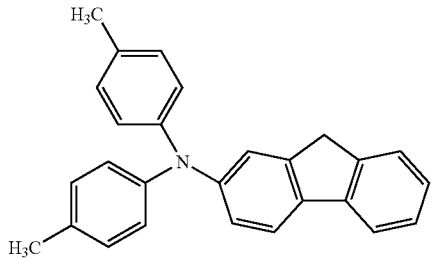

-continued

CT4-3

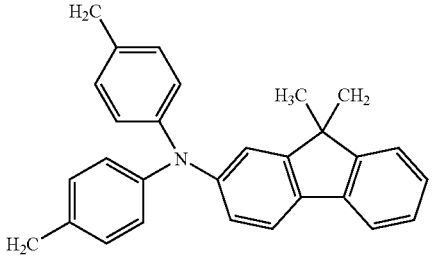

CT4-4

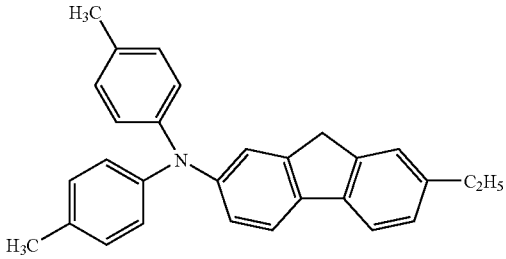

CT4-5

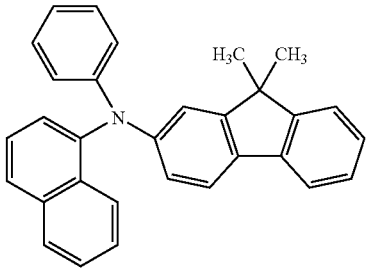

As the binder resin for charge transporting layer (CTL), any one of thermoplastic resin and thermosetting resin may be used. For example, polystyrene, acryl resin, methacrylic resin, vinyl chloride resin, vinyl acetate resin, polyvinyl butyral resin, epoxide resin, polyurethane resin, phenol resin, polyester resin, alkyd resin, polycarbonate resin, silicone resin, melamine resin range and copolymer resin including more than repetition units of two resins among these resins may be usable. Further, other than these insulation-related resin, high polymer organic semiconductor such as poly-N-vinyl carbazole may be usable. The most preferred material is polycarbonate resin in view of, smaller water absorbing rate, dispersing ability of the CTM and electro photosensitive characteristics.

Ratio of the binder resin is preferably 50 to 200 parts by mass to 100 parts of charge transporting material by weight. Total thickness of the charge transporting layer is preferably less than 20 μm, more preferably 10-16 μm. If the layer thickness exceeds 20 μm, the absorption or scattering of the short wave laser becomes large, then lowering of the sharpness and increasing of a residual voltage tends to take place.

It is desirable to make the contact angle of the surface of an organic photoreceptor over the water to be 90 to 130 by make a surface layer of the photoreceptor of a present invention (a 2nd charge transporting layer or a protective layer is formed on the above-mentioned charge transporting layer as the surface layer) to contain lubricative particles. When the lubricative particles are added to the surface layer of the electrophotographic photoreceptor, the lubricative particles are the material to reduce the surface energy of the electro-photographic photoreceptor. More concretely, by adding to the surface of the electro-photographic photoreceptor, the lubricative particles are the material to increase a contact angle (contact angle over pure water) of the electro-photographic photoreceptor.

Moreover, as the lubricative particles, if they are materials to increase the contact angle (contact angle over pure water) of the electrophotography photoreceptor, they are not limited to a specific material.

As such lubricative particles, fluororesin particles, such as polyvinylidene fluoride and polytetrafluoroethylene may be listed up as the most desirable material. Especially, fluorine-containing resin fine particles which contain a fluorine atom having a number average diameter (which means a median diameter $D_{50}$ based on number) of 0.01 to 2.0 μm and are excellent in releasing ability are desirable. Further, the average primary order particle diameter of the fluorine-containing resin fine particles is 0.02 μm or more and 0.2 μm or less is preferable. The fluorine-containing resin fine particles having the average primary order particle diameter of 0.02 μm to 0.2 μm has a good stability of a dispersion and can make the dispersion of a contact angle small.

In this specification, the average primary order particle diameter can be measured from a photograph taken from a sectional layer of a photoreceptor with a transmission type electron microscope. As the transmission type electron microscope, a device type well known among ordinary persons, such as LEM-2000 type (by Topcon Co,. Ltd.), JEM-2000FX (by Japan electronic Co,. Ltd.) may be used. More Concretely, firstly, a thin piece shaped sample is cut out from a photoreceptor by the use of Microtome equipped with a diamond tooth and the sectional layer condition of it is photographed with a 10000 time magnification. The number of fine particles conducted for TEM photography is at least 100 pieces or more.

The fine particles of fluorine-containing resin have a number average primary particle diameter from 0.02 μm inclusive to 0.20 μm exclusive, and a crystallinity of less than 90%. In case that the crystallinity is 90% or more, preferable dispersion property as well as the spreading property of the fine particles of fluorine-containing resin are obtained, and the absolute value of variation of contact angle are maintained. The crystallinity is preferably 40% or more.

To measure the crystallinity of the fine particles of fluorine-containing resin, the diffraction peak having occurred is separated into crystalline and non-crystalline portions according to wide-angle X-ray diffraction measurement. After baseline correction, the result is expressed in terms of the percentage of the X-ray integrated intensity of the crystalline portion (numerator) over the full X-ray integrated intensity of the crystalline and non-crystalline portions (denominator).

Measurements were made using the following wide-angle X-ray diffraction measuring apparatus under the following measuring conditions. If the same results as those by the wide-angle X-ray diffraction measuring apparatus can be obtained, another measuring instrument can be utilized.

X-ray generator: Rigaku RU-200B

Output: 50 kV, 150 mA

Monochromator: Graphite

Radiation source: CuK α (0.154184 nm)

Scanning range: $3 \leqq 2\theta \leqq 60$

Scanning method: θ-2θ

Scanning rate: 2/min

The fluorine-containing resin fine may be a homopolymer or a copolymer of a fluorine-containing polymerizable monomer, or a copolymer of a fluorine-containing polymerizable monomer and a fluorine free polymerizable monomer.

A fluorine-containing polymerizable monomer is shown by a general formula (4);

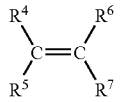

(4)

(In the formula, at least one of $R^4$-$R^7$ is a fluorine atom, and the remainings are a hydrogen atom, a chlorine atom, a methyl group, a monofluoro methyl group, a difluoro methyl group, or a trifluoro methyl group independently, respectively). As a preferable fluorine-containing polymerizable monomer, ethylene tetrafluoride, ethylene trifluoride, ethylene chloride trifluoride, propylene hexafluoride, vinyl fluoride, vinylidene fluoride, ethylene dichloride difluoride, etc. may be listed. As a fluorine-containing polymerizable monomer, two or more kinds of monomers may be used.

As a fluorine free polymerizable monomer, vinyl chloride and so on may be listed. As a fluorine free polymerizable monomer, two or more kinds of monomers may be used.

It may be preferable that the fluorine-containing resin fine particles are composed of a homopolymer or a copolymer of a fluorine-containing polymerizable monomer, and it is more preferable to use a poly ethylene tetrafluoride(PTFE), poly ethylene trifluoride, and ethylene tetrafluoride-propylene hexafluoride copolymer and polyvinylidene fluoride, and it may be especially preferable to use poly ethylene tetrafluoride.

Although the number average molecular weight of a polymer of the fluorine-containing resin fine particles is not limited as far as it can attain the object of the present invention, the number average molecular weight of a polymer of the fluorine-containing resin fine particles is preferably 10,000 to 1,000,000.

The degree of crystallinity of fluorine-containing resin fine particles changes according to the construction materials of the fluorine-containing resin fine particles, and it is changed also by conducting heat-treating for the fluorine-containing resin fine particles. For example, if PTFE fine particles (polyethylene terephthalate fine particles) whose number average primary particle diameter is 0.12 μm and degree of crystallinity is 91.3 are heat-treated for 65 minutes at 250° C., degree of crystallinity can be reduced to 82.8. A dryer or a heating furnace can be used for heat treatment.

As a binder resin in the above-mentioned surface layer, it is desirable to use a resin which has a surface activity group to help the dispersibility of fluorine-containing resin fine particles in a partial structure of the resin, for example, it is desirable to use polycarbonate and polyarylate which have a siloxane group in a partial structure.

(PC-1)
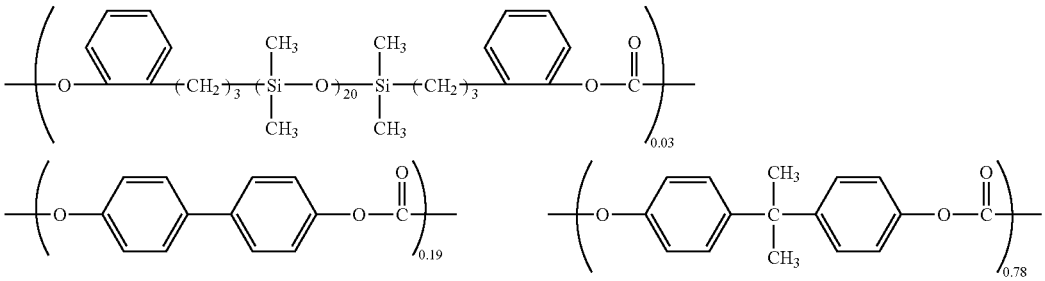
(PC-2)
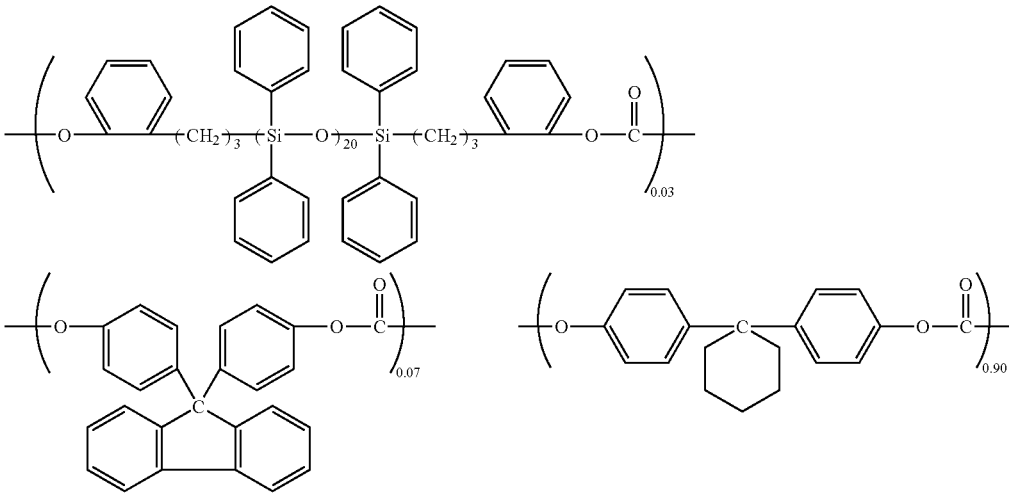
(PC-3)
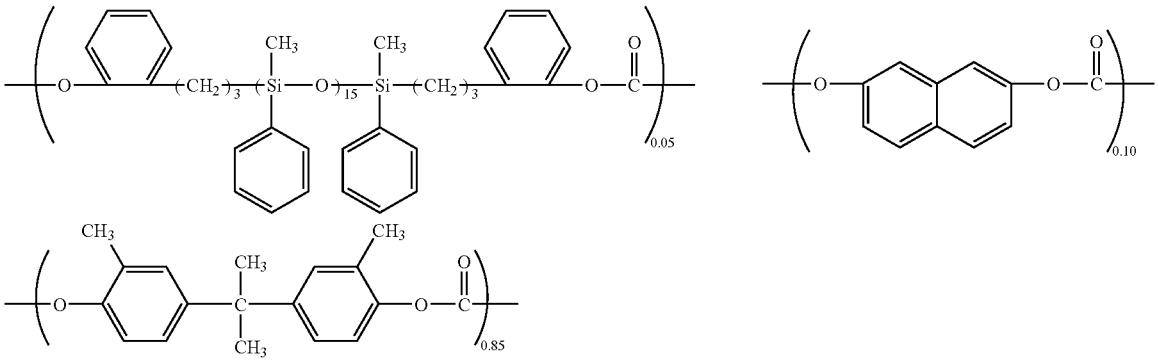
(PC-4)
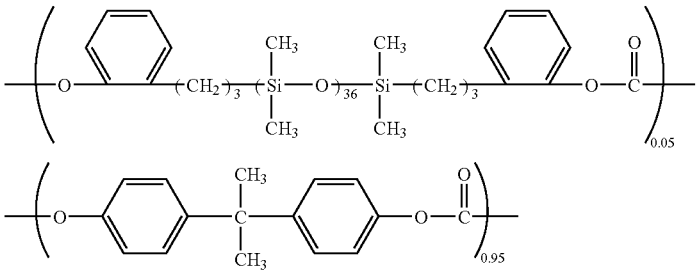
(PC-5)
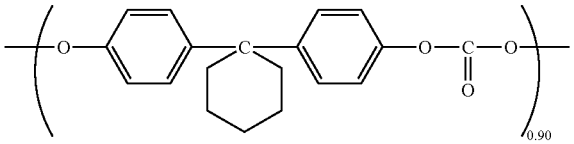

-continued

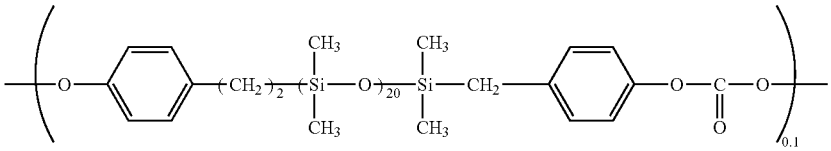

As for viscosity average molecular weight, 10,000-100,000 are desirable.

Moreover, in order to form a surface layer having a contact angle of 90 to 130 over water by the use of fluorine-containing resin fine particles, it is desirable to make the ratio of the fluorine-containing resin fine particles in the surface layer high, and it is desirable in mass ration to use it at least more than 20 mass parts and less than 200 mass parts to 100 mass parts of a binder resin. It is desirable to make the dispersion of the contact angle less than ±2.0°. By satisfying both of the contact angle and the dispersion of the contact angle at the same time, it may be possible to improve fog and lowering of image density at a leading portion which tend to take place in the counter development.

As the other lubricative particle materials, a fatty acid metal salt may be desirable. As the fatty acid metal salt, a metal salt of a saturation or unsaturated fatty acid having the number of carbon atoms of ten or more may be preferable. For example, aluminum stearate, indium stearate, gallium stearate, zinc stearate, lithium stearate, magnesium stearate, sodium stearate, palmitic acid aluminum, aluminium oleate, etc. are may be listed, and stearic acid metal salt and palmitic acid metal salt may be more preferably.

In the photoreceptor according to the present invention, the surface layer is made to contain lubricative particles and the contact angle of a photoreceptor for pure water is made to be 90 to 130, more preferably 95 to 120.

It is desirable to make the dispersion of the contact angle within ±2.0° of the average value. By making the dispersion of the contact angle within ±2.0° of the average value, it may be possible to prevent image density from lowering at a leading portion in the counter development.

Measurement of Contact Angle and its Variation

The contact angle in the sense is defined as the angle of contact to the surface of a photoreceptor with respect to pure water (at 20° C.). The contact angle of the photoreceptor is obtained by measuring the contact angle with respect to pure water using a contact angle meter (Model CA-DT.A by Kyowa Interface Science Co., Ltd.) at 20° C., 50% relative humidity.

This measurement was started after repeated image formation of at least several sheets, when the photoreceptor has conformed to the image formation. When the photoreceptor was cylindrical, measurement was carried out at three positions—at the center and 5 cm from the right and left ends, and at four positions at each 90° in the circumferential direction—i.e. at a total of 12 positions. The average of these measurements was assumed as the contact angle, and the values farthest from this average value in the positive and negative directions were assumed as variations. Similarly, when the photoreceptor was a sheet, measurement was carried out at three positions—at the center and 5 cm from the right and left ends, and at four positions at an equally spaced interval—i.e. at a total of 12 positions. The average of these measurements was assumed as the contact angle of the present invention, and the values farthest from this average value in the positive and negative directions were assumed as variations.

It is desirable to make the organic photoreceptor according to the present invention contain an antioxidant with the above-mentioned lubricative particles. By making the surface layer contain the lubricative particles and the antioxidant, the dispersion in the contact angle of the surface layer can be made small, the uniformity of a developing ability can be improved in the counter developing mode, and the occurrence of the lowering of an image density at the leading portion can be prevented.

An antioxidant is a substance which has a characteristic to prevent or refrain an action of oxygen under conditions, such as a light, heat, and electric discharge for an autoxidation substance which exists in the photoreceptor or on the surface of photoreceptor. The following compounds are exemplified.

(1) Radical chain inhibitor

Phenol type antioxidant (e.g. hindered phenols)

Amine type antioxidant (e.g. hindered amines, diallyl diamines, and diallyl amines)

Hydroquinone type antioxidant (2) Peroxide decomposer

Sulfur type antioxidant (e.g. Thioethers)

Phosphor type antioxidant (e.g. Phosphorous esters)

Radical chain inhibitor is preferably employed among compounds referred above. Hindered phenols and hindered amines antioxidants are particularly preferable. Two or more species of the compounds, for example, a combination of a hindered phenol antioxidant and a thioether antioxidant, may be employed. The antioxidants having a partial structure of hindered phenol, hindered amine, thioether, or phosphite may be employed.

Among the antioxidants, particularly, hindered phenol and hindered amine antioxidants are effective for such improvement of preventing occurrence of fogging and image density lowering at a leading portion in high temperature and high moisture condition.

Content of the antioxidant such as hindered phenol or hindered amine is preferably 0.01 to 20 mass % in the resin layer. If it is less than 0.01 mass %, it will be easy to generate a fog and a spot, and If it is more than 20 mass %, the fall-off of the electric charge transportation ability in a surface layer may occur, a residual potential tends to increase, an image density falls, a layer strength falls, and stripe-shaped unevenness may occur.

The hindered phenols as described herein means compounds having a branched alkyl group in the ortho position relative to the hydroxyl group of a phenol compound and derivatives thereof. The hydroxyl group may be modified to an alkoxy group.

The hindered amines are compounds having a bulky organic group in the neighborhood of a nitrogen atom, wherein an example of the bulky organic group is a branched alkyl group, and for example t-butyl is preferable. Listed as hindered amines are compounds having an organic group represented by the following structural formula:

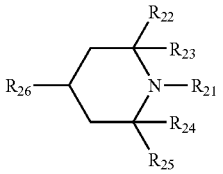

wherein $R_{21}$ represents a hydrogen atom or a univalent organic group, $R_{22}$, $R_{23}$, $R_{24}$, and $R_{25}$ each represents an alkyl group, and $R_{26}$ represents a hydrogen atom, a hydroxyl group, or a univalent organic group.

Listed as antioxidants having a partial hindered phenol structure are compounds described in JP O.P.I.No. 1-118137 (on pages 7 to 14).

Listed as antioxidants having a partial hindered amine structure are compounds described in JP O.P.I.No. 1-118138 (on pages 7 to 14).

Examples of organic phosphor compounds are those represented by a formula of RO—P(OR)—OR, wherein R is a hydrogen atom, an alkyl, alkenyl or aryl group which may have a substituent.

Examples of organic sulfur compounds are those represented by a formula of R—S—OR, wherein R is a hydrogen atom, an alkyl, alkenyl or aryl group which may have a substituent.

Representative antioxidants are listed.

1-1

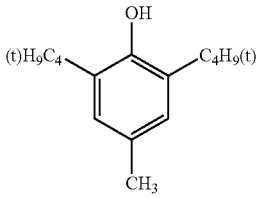

1-2

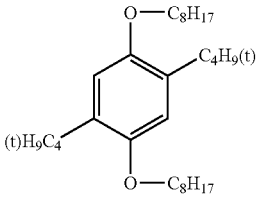

1-3

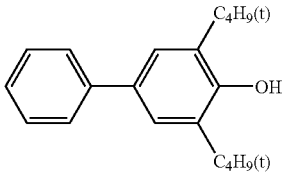

1-4

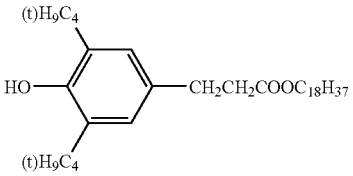

1-5

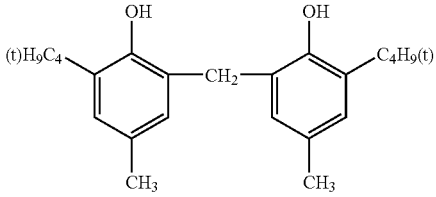

1-6

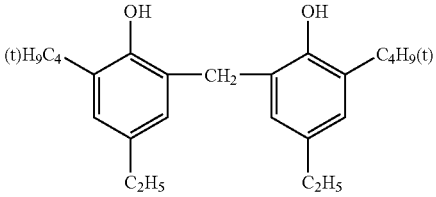

1-7

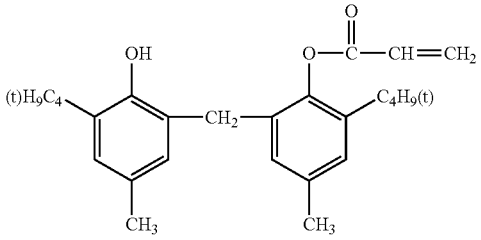

1-8

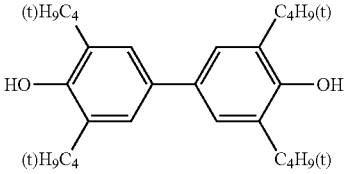

1-9

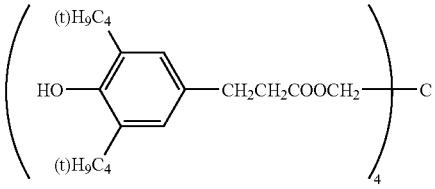

1-10

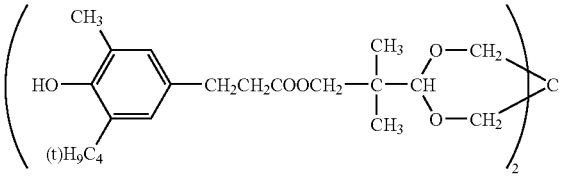

-continued
1-11
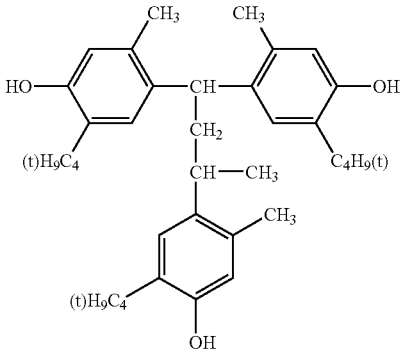
2-1
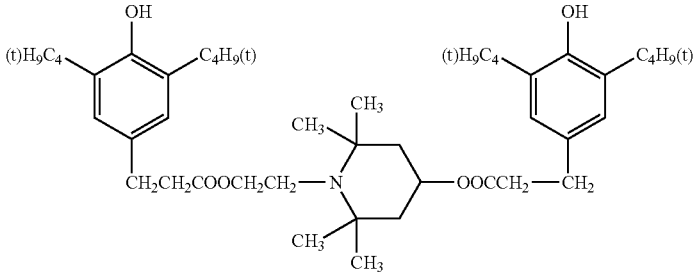
2-2
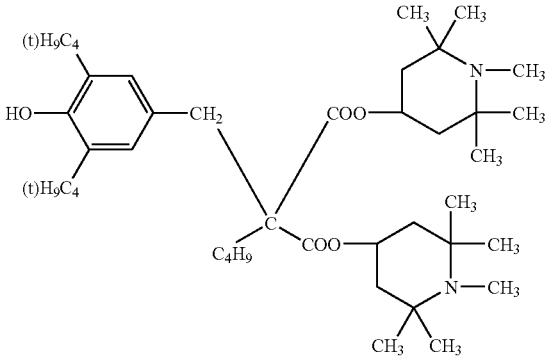
2-3
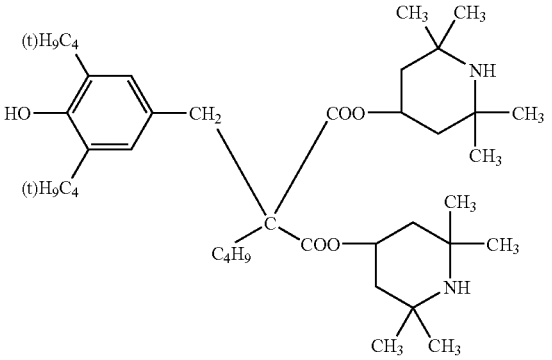
2-4
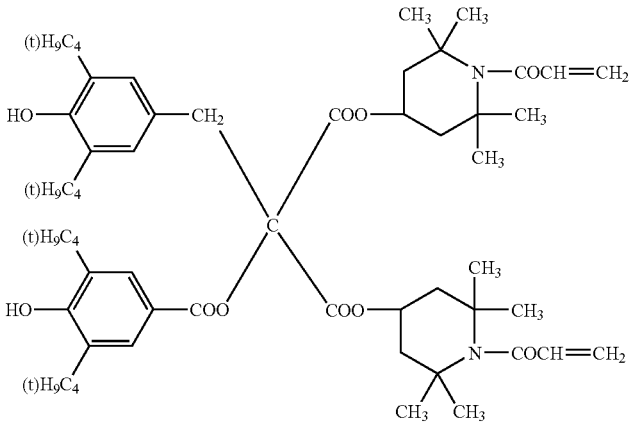

-continued 2-5

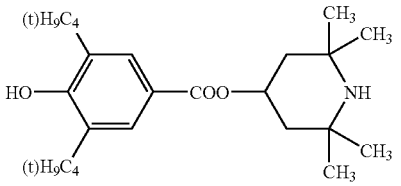

2-6

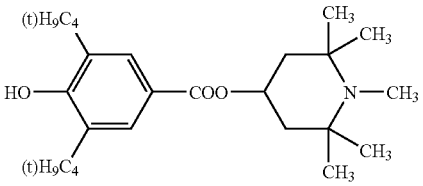

2-7

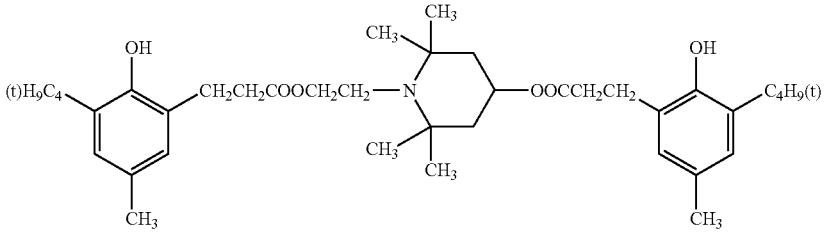

Examples of antioxidant available on the market include the followings.

Hindered phenol type antioxidant: IRGANOX 1076, IRGANOX 1010, IRGANOX 1098, IRGANOX 245, IRGANOX 1330, IRGANOX 3114, IRGANOX 1076, and 3,5-di-t-butyl-4-hydroxybiphenyl.

Hindered amine type antioxidant: SANOL LS2626, SANOL LS765, SANOL LS770, SANOL LS744, TINUVIN 144, TINUVIN 622LD, Mark LA57, Mark LA67, Mark LA62, Mark LA68 and Mark LA63.

As a charge transporting material (CTM), a known charge transporting material (CTM) of the positive hole transportation type (P type) can be used. For example, triphenylamines, hydrazones, styryl compound, benzidine compound, butadiene compound can be applied. These charge transporting materials are usually dissolved in a proper binder resin to form a layer.

Ratio of the binder resin is preferably 50 to 200 parts by weight to 100 parts of charge transporting material by weight.

As a solvent or a dispersion medium used for forming an intermediate layer, a photosensitive layer and a protective layer, n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane, 1,1,2-trichloroethane, 1,1,1-trichloroethane, trichloroethylene, tetrachloroethane, tetrahydrofuran, dioxolan, dioxane, methanol, ethanol, butanol, isopropanol, ethyl acetate, butyl acetate, dimethyl sulfoxide and methyl cellosolve may be listed. The present invention is not restricted to these one, dichloromethane, 1,2-dichloro ethane and methyl ethyl ketone are used preferably. Further, these solvents or dispersion media may also be used either independently or as mixed solvents of two or more types.

The coating liquids for each of the layers are each preferably filtered through a metal filter of a membrane filter before the coating process for removing the foreign matters and coagula in the coating liquids. For example, it is preferable that a pleats type filter HDC, a depth type filter Profile or a semidepth type filter profilester, each manufactured by Pall Corporation, is selected according to the properties of the coating liquid and employed for filtration.

Next, as a coating processing method for manufacturing an organic photoreceptor, other than a slide hopper type coating applicator, a coating processing method such as an immersion coating and a spray coating, can be used. It may be most desirable to use a ring shaped slide hopper type coating applicator for forming the surface layer according to present invention.

The method of coating with a quantity-regulated coating machine is most preferable to the aforementioned coating apparatus of coating composition supply type, when the dispersion using the aforementioned low-boiling point solvent is employed as a coating composition. In the case of a circular photoreceptor, it is preferred to coat it with the circular slide hopper coating machine described in details in the Japanese Patent O.P.I. 58-189061.

Referring to FIG. 1, the developing device of the counter developing mode will be described. Incidentally, the developing device shown in FIG. 1 is a developing device with a contact type two component developing method. However, the invention is not limited to the contact type two component developing method. For example, the invention is applied to a non-contact type one component developing method. The developing device 102 is arranged in such a manner that, at the opening part of the developing container 110 in which two-component developer is accommodated, the developing sleeve (a developing agent carrying member) 120 in which cylindrical magnet 121 is non-rotationally arranged, is arranged oppositely to the organic photoreceptor (an image carrying member) 101, and this developing sleeve 120 is rotated in the counter direction to the organic photoreceptor 101 rotating in the arrowed direction, and the developer attracted to and held on its surface is conveyed to a developing section opposed to the organic photoreceptor 101. The magnet 121 has the developing magnetic pole N1 on the organic photoreceptor 101 side, and has, from this developing magnetic pole N1 to the rotation direction of the developing sleeve 120, the first conveying magnetic pole S3, the second conveying magnetic pole N2, the third conveying magnetic pole S2 and a draw-up magnetic pole S1 in which the third conveying magnetic pole and a separation magnetic pole are structured.

The developer in the developing container 110 is attracted and held on the developing sleeve 120 by the action of the draw-up pole S1, at the position (draw-up position)Q on the surface of the developing sleeve 120 corresponding to the draw-up magnet pole S1 of the magnet 121, and arrives at the developing section after the layer thickness is regulated by the developing blade (a developing agent layer thickness regulating member) 122, and in the developing section, the magnetic brush (developing brush) is formed by the action of the developing magnetic pole N1, and the latent image on the organic photoreceptor 101 is developed.

The developer whose toner density is lowered by the development, is held on the developing sleeve 120 and returned to the inside of the developing container 110 by the action of the first, second conveying magnet poles S3, N2, and at the position (developer falling position) P on the surface of the developing sleeve 120 whose magnetic flux density is smallest, between the third conveying magnet pole S2 and the draw-up magnet pole S1, it is peeled off from the developing sleeve 120, and is dropped. On the developing sleeve from which the developer is peeled off, as described above, the new developer is attracted and held at the draw-up position Q.

Below the developing sleeve 120 in the developing container 110, the first mixing conveying member 123 is provided, and the second mixing conveying member 124 is further provided through the partition wall 140. These first, second mixing conveying members 123, 124 are screw type ones, and have spiral screw blade 128 and plate-like protrusion 130 between collars of its blade.

The developer whose toner density is low, which is peeled off from the developing sleeve 120, drops on the first mixing conveying member 123, and mixing-conveyed by the first mixing conveying member 123 together with the neighboring developer in the axial direction, and passes through the opening, not shown, of the one end portion of the partition wall 140, and it is delivered to the second mixing conveying member 124. The second mixing conveying member 124 conveys the delivered developer and the toner replenished from the replenishing port 118 of the developing container 110 while mixing them, in the rotation direction reverse to the above description, and passing through the opening, not shown, of the other end portion of the partition wall 140, returns them to the first mixing conveying member 123 side.

A preferred embodiment of a counter developing mode is explained. Incidentally, here, a gap between the photoreceptor 101 and the developing sleeve 120 in the developing section neighboring the developing magnet N1 in FIG. 1 is called a developing gap (Dsd), and the height of the magnetic brush formed on the developing sleeve 120 by the developing magnet N1 is called a developing brush height (h).

(1) Developing Gap (Dsd): 0.2 to 0.6 mm

When Dsd is made 0.2 to 0.6 mm, the development is conducted under a strong developing electric field and the attraction force to attract magnetic carriers onto the developing sleeve become larger so that the magnetic carriers are prevented from shifting and adhering onto the photoreceptor. Further, the developing electric field in the developing gap becomes higher, an edge effect becomes reduced and a developing ability is enhanced. Therefore, thinning of a transverse line image and a whitening of a trailing edge portion (developing failure at a trailing edge portion) can be prevented and the developing ability for a solid image can be enhanced.

(2) Magnetic Brush Bent Depth (Bsd): 0 to 0.8 mm, here, the Magnetic Brush Bent Depth (Bsd)=the Developing Brush Height (h)−the Developing Gap (Dsd)

When the magnetic brush bent depth (Bsd) is made 0 to 0.8 mm, the compression for the developing agent at the developing section is reduced and developing agent is prevented from slipping through a gap between the developing sleeve 120 and the developing blade 122. A developing failure for an isolating dot caused by an uneven contact of a magnetic brush and an increase of a roughness on a halftone image can be prevented. When the magnetic brush bent depth (Bsd) is less than zero, that is, under non contact condition, lowering of a developing density tends to take place. On the other hand, when the magnetic brush bent depth (Bsd) is larger than 0.8 mm, the developing agent flows out from a nip section and a even image formation is not expected.

(3) Peripheral Speed Ratio of Developing Sleeve to Photoreceptor (Vs/Vopc): 1.2 to 3.0

When the peripheral speed ratio of developing sleeve to photoreceptor (Vs/Vopc) is made 1.2 to 3.0, a high developing ability can be obtained. If the peripheral speed ratio is increased excessively, the contact frequency of magnetic brush on the developing sleeve against the photoreceptor becomes high excessively. Then, the contacting force of the magnetic brush against the photoreceptor, that is, a mechanical force becomes strong excessively and carrier tends to separate away from the magnetic brush and the carrier tends to adhere onto the photoreceptor. As a result, a brush mark is caused on a toner image on the photoreceptor by the magnetic brush. On the contrary, if the peripheral speed ratio is decreased excessively, the contact frequency of magnetic brush on the developing sleeve against the photoreceptor reduces excessively, the developing ability is lowered. Therefore, when the peripheral speed ratio is less than 1.2, the image density tends to become low, and when the peripheral speed ratio is larger than 3.0, toner scattering, carrier adhesion, a durability problem of the developing sleeve may take place. In contrast, when the peripheral speed ratio is made within the above range, the brush mark can be prevented. Further, the edge effect is prevented from being enhanced due to an excessive high developing ability.

(4) Developing Bias Condition

It is desirable that a difference |Vo-Vdc| between the surface electric potential Vo of the photoreceptor and a direct-current component Vdc of a developing bias is made 50 to 300 V, a direct-current component Vdc of a developing bias is made −50 V to −400 V, an alternate current component Vac of the developing bias is made 0.5 to 2.0 KV, frequency is made 3 to 9 KHz, duty ratio is made 45 to 70% (the time ratio of the developing side in a rectangular wave), the shape of the alternate current component is made to be a rectangular wave. Namely, in a small size two component type developing apparatus in which the outer diameter of the developing sleeve is 30 mm or less and the outer diameter of the photoreceptor is 60 mm or less, since a developing nip width becomes small due to the small diameter of the developing sleeve, the developing ability becomes lowered. However, with the above developing bias condition, the lowering of the developing ability can be improved.

Next, a process cartridge and the electronic photographing apparatus according to the present invention will be described. A schematic structure of the electronic photographing apparatus having the process cartridge having the organic photoreceptor of the present invention is shown in FIG. 2.

Figure 2:
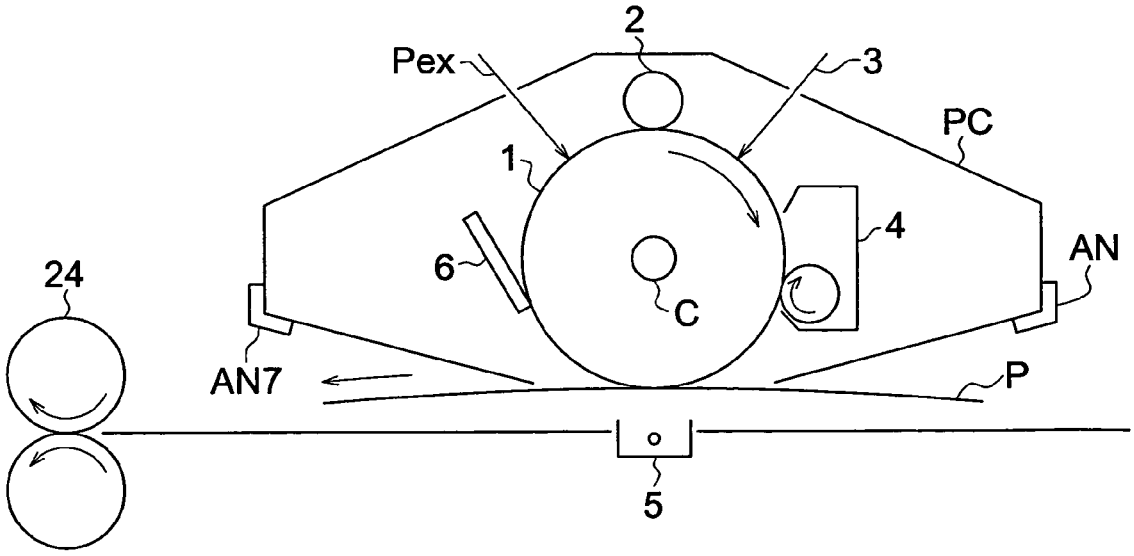
FIG. 2 is a schematic view of an example of an electrophotographic apparatus comprising a process cartridge including an organic photoreceptor.

In FIG. 2, numeral 11 is a drum-like organic photoreceptor of the present invention, and is rotated at a predetermined peripheral speed in the arrowed direction around the axis 12. In the rotation process, the organic photoreceptor 11 receives the uniform charging of the positive or negative predetermined potential on its peripheral surface by the primary charging means 13, next, receives the emphasized and modulated exposure light 14 corresponding to the time series electric digital image signal of the image information for the purpose that it is outputted from the exposure means (not shown) such as a slit exposure or laser beam scanning exposure. In this manner, on the peripheral surface of the organic photoreceptor 11, electro-static latent images corresponding to a target image information are successively formed.

The formed electrostatic latent image is next toner-developed by the developing means 15, and onto the transfer material 17 which is taken out and fed from the sheet feeding section, not shown, in timed relationship with the rotation of the organic photoreceptor 11 between the organic photoreceptor 11 and the transfer means 16, the toner images which are formed and held on the surface of the organic photoreceptor 11, are successively transferred by the transfer means 16.

The transfer material 17 onto which the toner image is transferred, is separated from the surface of the organic photoreceptor and when it is introduced into the image fixing means 18 and image-fixed, printed out to the outside of the apparatus as the image formed material (print, copy).

The surface of the organic photoreceptor 11 after the image transferring, is cleaned when the remained toner of the transferring is removed by the cleaning means 19, and further after the surface is discharging-processed by the preexposure light 20 from the preexposure means (not shown), it is repeatedly used for the image formation. Hereupon, when the primary charging means 13 is a contact charging means using the charging roller, the preexposure is not always necessary.

In the present invention, in the components such as the above organic photoreceptor 11, primary charging means 13, developing means 15 and cleaning means 19, a plurality ones are accommodated in a casing 21 and structured by being integrally combined as a process cartridge, and this process cartridge may also be detachably structured for the electronic photographing apparatus main body such as the copier or laser beam printer. For example, at least one of the primary charging means 13, developing means 15 and cleaning means 19, is integrally supported with the organic photoreceptor 11 and made into the cartridge, and by using the guiding means 22 such as rails of the apparatus main body, it can be made a process cartridge which is detachable for the apparatus main body.

Further, an embodiment of a printer of the electronic photographing system (hereinafter, simply called printer) as the full-color image forming apparatus to which the present invention is applied, will be described bellow.

Figure 3:
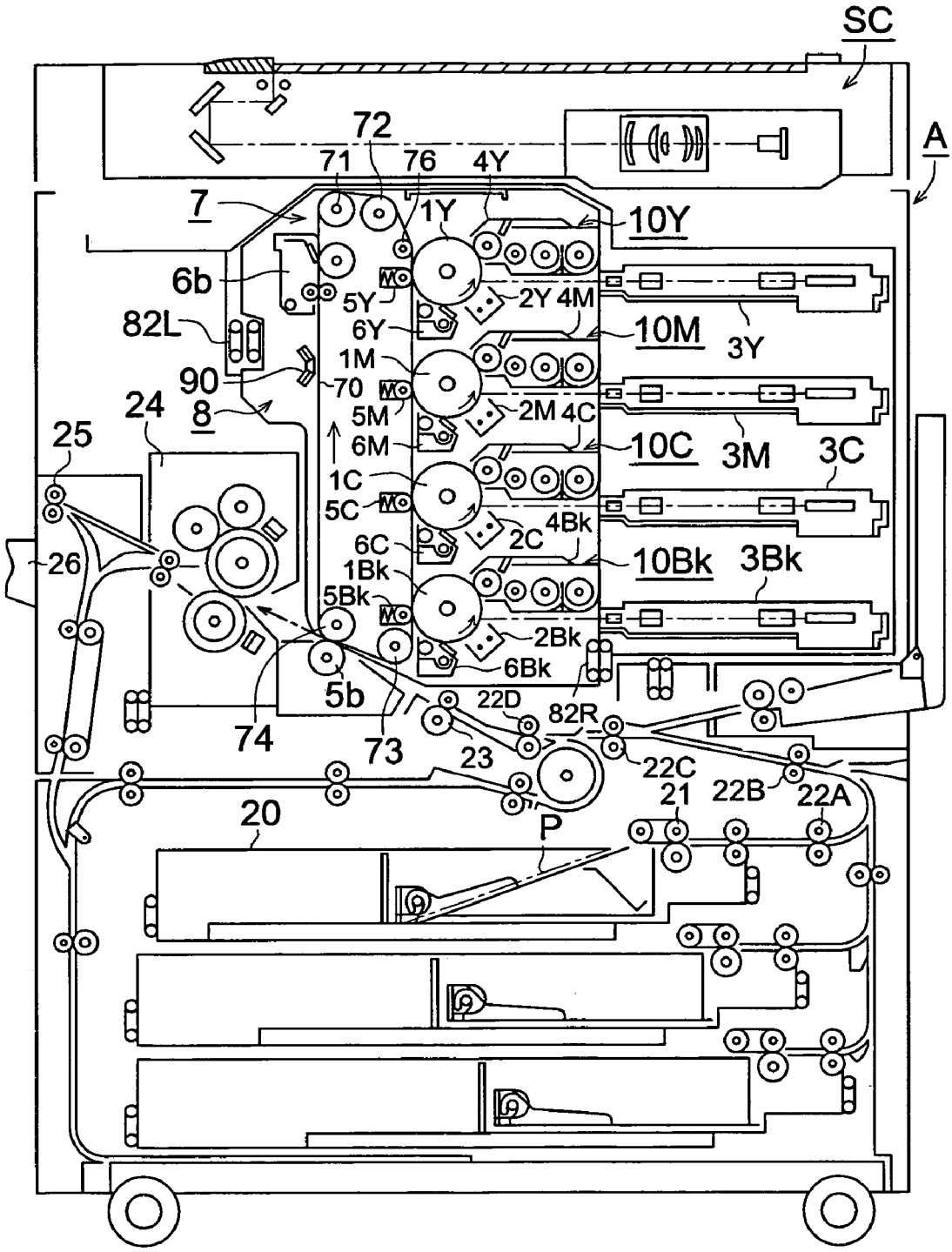
FIG. 3 is a sectional schematic view of a color image forming apparatus relating to one example of the invention.
Figure 4:
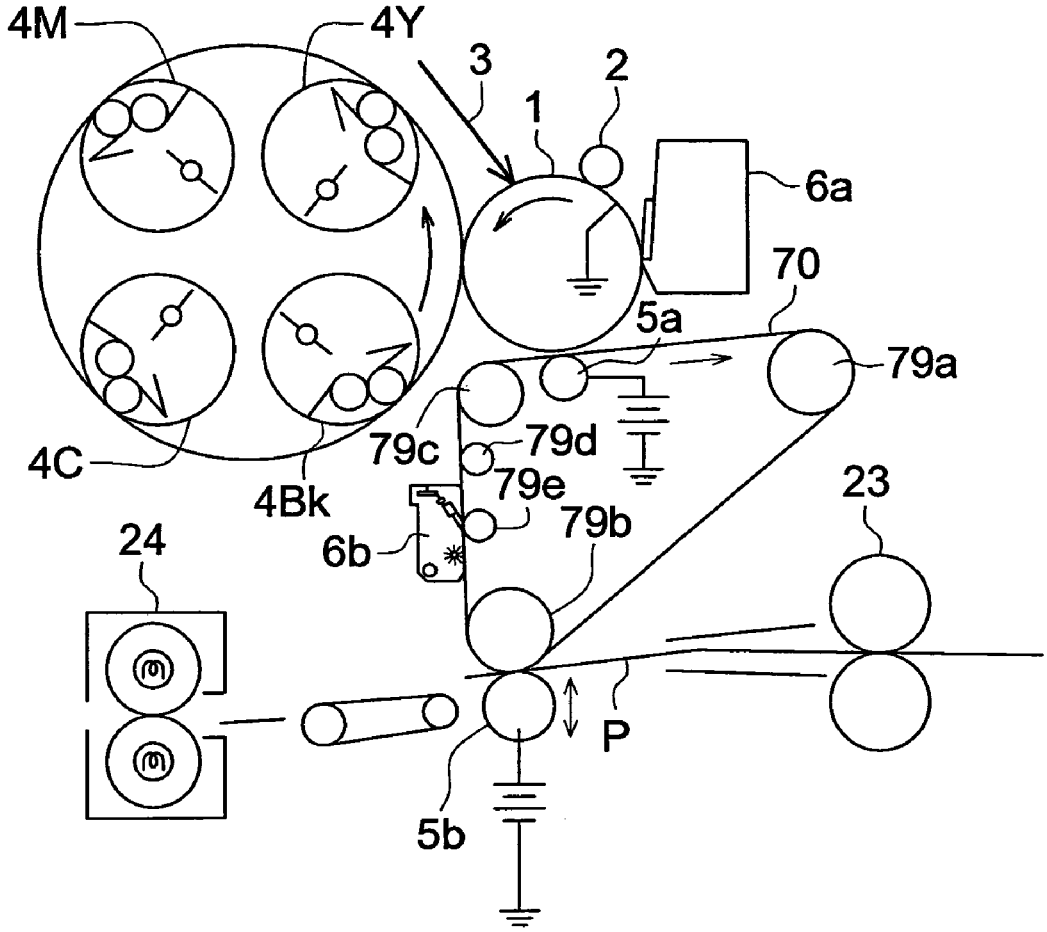
FIG. 4 is a sectional schematic view of a color image forming apparatus relating employing an organic photoreceptor.

FIG. 3 is a cross-sectional configuration view diagram of a color image forming apparatus showing a preferred embodiment of the present invention.

This color image forming apparatus is of the so called tandem type color image forming apparatus, and comprises four sets of image forming sections (image forming units) 10Y, 10M, 10C, and 10Bk, an endless belt shaped intermediate image transfer body unit 7, a sheet feeding and transportation means 21, and a fixing means 24. The original document reading apparatus SC is placed on top of the main unit A of the image forming apparatus.

The image forming section 10Y that forms images of yellow color comprises a charging means (charging process) 2Y, an exposing means (exposing process) 3Y, a developing means (developing process) 4Y, a primary transfer roller 5Y as a primary transfer means (primary transfer process), and a cleaning means 6Y all placed around the drum shaped photoreceptor 1Y which acts as the first image supporting body. The image forming section 10M that forms images of magenta color comprises a drum shaped photoreceptor 1M which acts as the first image supporting body, a charging means 2M, an exposing means 3M, a developing means 4M, a primary transfer roller 5M as a primary transfer means, and a cleaning means 6M. The image forming section 10C that forms images of cyan color comprises a drum shaped photoreceptor 1C which acts as the first image supporting body, a charging means 2C, an exposing means 3C, a developing means 4C, a primary transfer roller 5C as a primary transfer means, and a cleaning means 6C. The image forming section 10Bk that forms images of black color comprises a drum shaped photoreceptor 1Bk which acts as the first image supporting body, a charging means 2Bk, an exposing means 3Bk, a developing means 4Bk, a primary transfer roller 5Bk as a primary transfer means, and a cleaning means 6Bk.

Said four sets of image forming units 10Y, 10M, 10C, and 10Bk are constituted, centering on the photosensitive drums 1Y, 1M, 1C, and 1Bk, by the rotating charging means 2Y, 2M, 2C, and 2Bk, the image exposing means 3Y, 3M, 3C, and 3Bk, the rotating developing means 4Y, 4M, 4C, and 4Bk, and the cleaning means 5Y, 5M, 5C, and 5Bk that clean the photosensitive drums 1Y, 1M, 1C, and 1Bk.

Said image forming units 10Y, 10M, 10C, and 10Bk, all have the same configuration excepting that the color of the toner image formed in each unit is different on the respective photosensitive drums 1Y, 1M, 1C, and 1Bk, and detailed description is given below taking the example of the image forming unit 10Y.

The image forming unit 10Y has, placed around the photosensitive drum 1Y which is the image forming body, a charging means 2Y (hereinafter referred to merely as the charging unit 2Y or the charger 2Y), the exposing means 3Y, the developing means 4Y, and the cleaning means 5Y (hereinafter referred to merely as the cleaning means 5Y or as the cleaning blade 5Y), and forms yellow (Y) colored toner image on the photosensitive drum 1Y. Further, in the present preferred embodiment, at least the photosensitive drum 1Y, the charging means 2Y, the developing means 4Y, and the cleaning means 5Y in this image forming unit 10Y are provided in an integral manner.

The charging means 2Y is a means that applies a uniform electrostatic potential to the photosensitive drum 1Y, and a corona discharge type of charger unit 2Y is being used for the photosensitive drum 1Y in the present preferred embodiment.

The image exposing means 3Y is a means that carries out light exposure, based on the image signal (Yellow), on the photosensitive drum 1Y to which a uniform potential has been applied by the charging means 2Y, and forms the electrostatic latent image corresponding to the yellow color image, and an array of light emitting devices LEDs and imaging elements (product name: selfoc lenses) arranged in the axial direction of the photosensitive drum 1Y or a laser optical system etc., is used as this exposing means 3Y.

In an image forming apparatus according to the present invention, when forming a latent image on a photoreceptor, it is assumed to use a semiconductive laser or a light emitting diode having a oscillating wavelength of 350 to 500 nm as an image exposure light source. By making an exposure light dot diameter to 10 to 50 μm in a writing main scanning direction with the above image exposure light source, and by conducting a digital exposure on an organic photoreceptor, it is possible to obtain an electro-photographic image having a high resolution of 600 dpi to 2500 dpi (dpi: the number of dots per 25.4 cm).

Said exposure dot diameter is the length of the exposure beam (Ld: Length measured at the maximum position) along the main scanning direction of the area in which the intensity of said exposure beam is $1/e^2$ or more times the peak intensity.

The optical beams used can be a scanning optical system using a semiconductor laser or a fixed scanner using LEDs, etc. The light intensity distribution can be Gaussian distribution or Lorentz distribution, and in either case, the area with a light intensity of $1/e^2$ or more than the peak intensity is considered as the exposure dot diameter according to the present invention.

The images of different colors formed by the image forming units 10Y, 10M, 10C, and 10Bk, are successively transferred on to the rotating endless belt shaped intermediate image transfer body 70 by the primary transfer rollers 5Y, 5M, 5C, and 5Bk acting as the primary image transfer means, thereby forming the synthesized color image. The transfer material P as the transfer material stored inside the sheet feeding cassette 20 (the supporting body that carries the final fixed image: for example, plain paper, transparent sheet, etc.,) is fed from the sheet feeding means 21, pass through a plurality of intermediate rollers 22A, 22B, 22C, and 22D, and the resist roller 23, and is transported to the secondary transfer roller 5*b* which functions as the secondary image transfer means, and the color image is transferred in one operation of secondary image transfer on to the transfer material P. The transfer material P on which the color image has been transferred is subjected to fixing process by the fixing means 24, and is gripped by the sheet discharge rollers 25 and placed above the sheet discharge tray 26 outside the equipment. Here, the transfer supporting body of the toner image formed on the photoreceptor of the intermediate transfer body or of the transfer material, etc. is comprehensively called the transfer media.

On the other hand, after the color image is transferred to the transfer material P by the secondary transfer roller 5*b* functioning as the secondary transfer means, the endless belt shaped intermediate image transfer body 70 from which the transfer material P has been separated due to different radii of curvature is cleaned by the cleaning means 6*b* to remove all residual toner on it.

During image forming, the primary transfer roller 5Bk is at all times pressing against the photoreceptor 1Bk. Other primary transfer rollers 5Y, 5M, and 5C come into pressure contact respectively with their corresponding photoreceptor 1Y, 1M, and 1C only during color image forming.

The secondary transfer roller 5*b* comes into pressure contact with the endless belt shaped intermediate transfer body 70 only when secondary transfer is to be made by passing the transfer material P through this.

Further, the chassis 8 can be pulled out via the supporting rails 82L and 82R from the body A of the apparatus.

The chassis 8 comprises the image forming sections 10Y, 10M, 10C, and 10Bk, and the endless belt shaped intermediate image transfer body unit 7.

The image forming sections 10Y, 10M, 10C, and 10Bk are arranged in column in the vertical direction. The endless belt shaped intermediate image transfer body unit 7 is placed to the left side in the figure of the photosensitive drums 1Y, 1M, 1C, and 1Bk. The endless belt shaped intermediate image transfer body unit 7 comprises the endless belt shaped intermediate image transfer body 70 that can rotate around the rollers 71, 72, 73, and 74, the primary image transfer rollers 5Y, 5M, 5C, and 5Bk, and the cleaning means 6*b*.

Next, FIG. 5 shows the cross-sectional configuration view diagram of a color image forming apparatus using an organic photoreceptor according to the present invention (a copier or a laser beam printer having at least a charging means, an exposing means, a plurality of developing means, image transfer means, cleaning means, and intermediate image transfer body around the organic photoreceptor). An elastic material with a medium level of electrical resistivity is being used for the belt shaped intermediate image transfer body 70.

In this figure, 1 is a rotating drum type photoreceptor that is used repetitively as the image carrying body, and is driven to rotate with a specific circumferential velocity in the anti-clockwise direction shown by the arrow.

During rotation, the photoreceptor 1 is charged uniformly to a specific polarity and potential by the charging means (charging process) 2, after which it receives from the image exposing means (image exposing process) 3 not shown in the figure image exposure by the scanning exposure light from a laser beam modulated according to the time-serial electrical digital pixel signal of the image information thereby forming the electrostatic latent image corresponding to the yellow (Y) color component (color information) of the target color image.

Next, this electrostatic latent image is developed by the yellow (Y) developing means: developing process (yellow color developer) 4Y using the yellow toner which is the first color. At this time, the second to the fourth developing means (magenta color developer, cyan color developer, and black color developer) 4M, 4C, and 4Bk are each in the operation switched-off state and do not act on the photoreceptor 1, and the yellow toner image of the above first color does not get affected by the above second to fourth developers.

The intermediate image transfer body 70 is wound over the rollers 79*a*, 79*b*, 79*c*, 79*d*, and 79*e* and is driven to rotate in a clockwise direction with the same circumferential speed as the photoreceptor 1.

The yellow toner image of the first color formed and retained on the photoreceptor 1 is, in the process of passing through the nip section between the photoreceptor 1 and the intermediate image transfer body 70, intermediate transferred (primary transferred) successively to the outer peripheral surface of the intermediate image transfer body 70 due to the electric field formed by the primary transfer bias voltage applied from the primary transfer roller 5*a* to the intermediate image transfer body 70.

The surface of the photoreceptor 1 after it has completed the transfer of the first color yellow toner image to the intermediate image transfer body 70 is cleaned by the cleaning apparatus 6*a*.

In the following, in a manner similar to the above, the second color magenta toner image, the third color cyan toner image, and the fourth color black toner image are transferred successively on to the intermediate image transfer body 70 in a superimposing manner, thereby forming the superimposed color toner image corresponding to the desired color image.

The secondary transfer roller 5*b* is placed so that it is supported by bearings parallel to the secondary transfer opposing roller 79*b* and pushes against the intermediate image transfer body 70 from below in a separable condition.

In order to carry out successive overlapping transfer of the toner images of the first to fourth colors from the photoreceptor 1 to the intermediate image transfer body 70, the primary transfer bias voltage applied has a polarity opposite to that of the toner and is applied from the bias power supply. This applied voltage is, for example, in the range of +100V to +2 kV.

During the primary transfer process of transferring the first to the third color toner image from the photoreceptor 1 to the intermediate image transfer body 70, the secondary transfer roller 5*b* and the intermediate image transfer body cleaning means 6*b* can be separated from the intermediate image transfer body 70.

The transfer of the superimposed color toner image transferred on to the belt shaped intermediate image transfer body on to the transfer material P which is the second image supporting body is done when the secondary transfer roller 5*b* is in contact with the belt of the intermediate image transfer body 70, and the transfer material P is fed from the corresponding sheet feeding resist roller 23 via the transfer sheet guide to the contacting nip between the secondary transfer roller 5*b* and the intermediate image transfer body 70 at a specific timing. The secondary transfer bias voltage is applied from the bias power supply to the secondary image transfer roller 5*b*. Because of this secondary transfer bias voltage, the superimposed color toner image is transferred (secondary transfer) from the intermediate image transfer body 70 to the transfer material P which is the second image supporting body. The transfer material P which has received the transfer of the toner image is guided to the fixing means 24 and is heated and fixed there.

The image forming method according to the present invention can be applied in general to all electro-photographic apparatuses such as electro-photographic copiers, laser printers, LED printers, and liquid crystal shutter type printers, and in addition, it is also possible to apply the present invention to a wide range of apparatuses applying electro-photographic technology, such as displays, recorders, light printing equipment, printing screen production, and facsimile equipment.

EXAMPLE

Although examples are given and this invention is hereafter explained to details, the aspect of this invention is not limited to this. Incidentally, "part" in the following sentences represents "parts by weight".

Manufacture of Photoreceptor 1

The photoreceptor 1 was produced as follows.

The surface of cylinder type aluminum base support was subjected to a cutting process, and a conductive base support of surface roughness Rz=1.5 (μm) was prepared.

<Intermediate Layer>

Intermediate Layer 1

On the above-mentioned conductive base support, the following intermediate layer coating solution was coated by an immersion coating method, dried under 120° C. for 30 minutes, and whereby an intermediate layer 1 having a dried coating layer thickness of 1.0 micrometers was formed.

The following intermediate layer dispersion liquid was diluted twice with the same mixed solvent, and filtered after settling for overnight (filter; NihonPall Ltd. company make RIGIMESH 5 μm filter), whereby the intermediate layer coating solution was produced.

| (Production of a dispersion of an intermediate layer) | |
|---|---|
| Binder resin, (exemplified Polyamide N-1) | 1 part (1.0 part by volume) |
| N-type semiconductive particles; Rutile type titanium oxide A1 (number average primary particle diameter of 35 nm: subjected to surface treatment by titanium oxide subjected to a copolymer of methyl hydrogen polysiloxane and dimethylsiloxane, molar ratio = 1:1, in amount of 5 weight % of the titanium oxide) | 3.5 parts (1.0 part by volume) |
| Ethanol/n-propylalcohol/THF (=45/20/30 by weight) | 10 parts |

The above-mentioned composites were mixed, dispersion was performed for 10 hours by a batch system, using a sand mill homogenizer, and whereby intermediate layer dispersion liquid was produced.

| <Electric Charge Generating Layer: CGL> | |
|---|---|
| Electric-charge generating substance (CGM): Above CG 1-5 | 24 parts |
| Polyvinyl butyral resin "Eslek BL-1" (made by Sekisui Chemical Co., Ltd.) | 12 parts |
| 2-butanone/cyclohexanone = 4/1 (v/v) | 300 parts |

The following composition was mixed and dispersed by use of a sand mill, resulting in preparation of a charge generating layer coating solution. This solution was coated on the aforesaid intermediate layer by means of an immersion coating method to form a charge generating layer having a dry layer thickness of 0.5 μm.

| <Charge transporting layer (CTL)> | |
|---|---|
| Electric charge transportation material (CTM): the above CT2-35 | 225 parts |
| Polycarbonate (Z300: manufactured by a Mitsubishi Gas Chemical Company INC. company) | 300 parts |
| Antioxidant (an exemplified compound AO1-3) | 6 parts |
| THF/toluene mixed-solution (volume ratio 3/1 mixing) | 2000 parts |
| Silicone oil (KF-54: made by Shin-Etsu Chemical Co., Ltd. company) | 1 Part |

The above-mentioned compositions were mixed and dissolved, thereby a charge transporting layer coating solution 1 was prepared. This coating solution was coated on the above-mentioned charge generation layer by the immersion coating method, and was subjected to a dry process at 110° C. for 70 minutes, whereby the charge transporting layer of 16.0 μm of dried coating layer thickness was formed.

Manufacture of Photoreceptor 2

The photoreceptor 2 was produced in the similar manner with the photoreceptor 1, except that CGM of the photoreceptor 1 was changed from CG1-5 to CG2-17.

Manufacture of Photoreceptor 3

The photoreceptor 3 was produced in the similar manner with the photoreceptor 1, except that CGM of the photoreceptor 1 was changed from CG1-5 to CG3-1/CG3-2/CG3-3 (1/2/1 mass ratio) and CTM was changed from CT2-35 to CT1-7.

Manufacture of Photoreceptor 4

On the charge transporting layer of the photoreceptor 1, the following PTFE dispersion was prepared and a protective layer was coated.

<Preparation of polytetrafluoroethylene resin particle (PTFE particles) dispersion liquid>

PTFE particles (PTFE particles having a number average first order particle diameters of 0.12μm and a degree of crystallinity 91.3) were heat-treated for 40 minutes at 250° C. to make the degree of crystallinity to 82.8, and the following PTFE particle dispersion liquid was prepared using the PTFE particles.

| | |
|---|---|
| PTFE particles (PT1: number average first order particle diameters of 0.12 μm, and degree of crystallinity of 82.8) | 200 parts |
| Toluene | 600 parts |

-continued

| | |
|---|---|
| Fluorine based comb type graft polymer (a product name GF300, manufactured by Toagosei Co., Ltd. Chemistry) | 15 parts |

After mixing the above-mentioned compositions, the resultant mixture was dispersed with a sand grinder (manufactured by Amex company) using glass bead, and whereby PTFE particle dispersion liquid was prepared.

| <Protective layer><br><Charge transporting layer 2 (CTL2)> | |
|---|---|
| PTFE particle dispersion liquid | 815 parts |
| Electric charge transportation materials (the above CTM4) | 150 parts |
| Siloxane-modified polycarbonate resin (PC-1) | 150 parts |
| Polycarbonate (Z300: manufactured by a Mitsubishi Gas Chemical Company INC. company) | 150 parts |
| Antioxidant (Irganox 1010: made by Ciba-Geigy Japan) | 12 parts |
| THF: Tetrahydrofuran | 2800 parts |
| Silicone oil (KF-54: made by a Shin-Etsu Chemical Co., Ltd. company) | 4 Parts |

The above-mentioned compositions were mixed and dissolved, thereby a charge transporting layer 2 coating solution was prepared. This coating solution was coated on the above-mentioned charge transporting layer by a circular slide hopper type coating apparatus, and was subjected to a dry process at 110° C. for 70 minutes, whereby the charge transporting layer of 2.0 μm of dried coating layer thickness was formed.

TABLE 1

| Photoreceptor No. | CGM in CGL | CTM in CTL | Protective layer |
|---|---|---|---|
| 1 | CG1-5 | CT2-35 | NO |
| 2 | CG2-17 | CT2-35 | NO |
| 3 | CG3-1/CG3-2/CG3-3 | CT1-7 | NO |
| 4 | CG1-5 | CT2-35 | YES |

Preparation of Carrier

Preparation of Carriers 1-5

After pulverizing and mixing MnO: 10 mol % and MgO: 39 mol % and $Fe_2O_3$: 50 mol and $SnO_2$: 1 mol % for 5 hours with a wet ball mill and drying these mixture, the mixture was held at 850° C. for 1 hour, and temporary baking was performed. Then, by pulverizing these for 5 hours with a wet ball mill, these were made 3 μm or less. This slurry was added with a proper quantity of a dispersing agent and a binder, and were agglomerated and dried, whereby the agglomerated material was obtained.

With an electric furnace of an air atmosphere, this agglomerated material was held at 1200° C. for 4 hours, and a main baking was performed. Then, subsequently, the material was pulverized, and classified by changing a classification condition further, whereby ferrite carriers (the volume average particle diameter of 8 micrometers, 12 micrometers, 35 micrometers, 58 micrometers, and 65 micrometers) were obtained. By making this as a core material, 100 parts of a mixture (mass ratio=(2):(3)=40:60) of a silicone resin whose combination of $R_5$ and $R_6$ in the general formula (2) is a methyl group and a hydroxyl group and a silicone resin whose substituted groups in the general formula (3) are a methyl group, 10 parts of a silane coupling agent (an exemplified compound (1)), and 5 parts of oxime type hardeners (an exemplified compound (15)) were mixed, and whereby a toluene solution having a solid content concentration of 15 mass % was prepared.

Subsequently, a spray drying process was conducted such that a covered layer amount to one magnetic-substance particle at the first coating became 1.5 mass % and a hardening process was performed with a heating temperature of 200° C. for 3 hours. Further, a spray drying process was conducted such that a covered layer amount at the second coating to coat with a silicone resin became 0.8 mass % and a hardening process was performed with a heating temperature of 250° C. for 3 hours, whereby ferrite carriers 1 to 5 covered with a resin were obtained in correspondence with 8 μm, 12 μm, 35 μm, 35 μm and 65 μm respectively.

Preparation of Carriers 6-9

Mn—Mg—Sn based ferrite carriers 6 to 9 having a volume average particle diameter of 35 μm were obtained with the similar manner as Example 1 except that compositions of MnO, MgO, $Fe_2O_3$ and $SnO_2$ was changed as shown in Table 1.

Saturation magnetization was measured for the ferrite carriers 1-9.

TABLE 2

| | Composition of carrier | | | | Volume average particle diameter | Saturation magnetization |
|---|---|---|---|---|---|---|
| Carrier No. | $Fe_2O_3$ | MnO | $SnO_2$ | MgO | (μm) | (emu/g) |
| 1 | 50 | 10 | 1 | 39 | 8 | 35 |
| 2 | 50 | 10 | 1 | 39 | 12 | 35 |
| 3 | 50 | 10 | 1 | 39 | 35 | 35 |
| 4 | 50 | 10 | 1 | 39 | 58 | 35 |
| 5 | 50 | 10 | 1 | 39 | 65 | 35 |
| 6 | 45 | 10 | 10 | 35 | 35 | 15 |
| 7 | 50 | 10 | 5 | 35 | 35 | 25 |
| 8 | 60 | 30 | 1 | 9 | 35 | 75 |
| 9 | 65 | 30 | 1 | 4 | 35 | 85 |

Production of Toner

* Production of Toner Bk, Toner Y, Toner M, Toner C

Sodium n-dodecylsulfate of 0.90 kg and 10.0 L of pure water were put in a vessel and dissolved while being stirred. Then, this solution was gradually added with 1.20 kg of Regal 330R (carbon black manufactured by Cabot Corp.) while stirring, then this solution was continuously dispersed by the use of a sand grinder (a medium type homogenizer) for successive 20 hours. As a result of measuring the particle size of the above-mentioned dispersion liquid by using an electrophoresis light-scattering photometer ELS-800 by an OTSUKA ELECTRONICS CO., LTD. company, it was 112 nm in weight average diameter. Moreover, the solid content concentration of the above-mentioned dispersion liquid measured with the weighing method by standing desiccation was 16.6 mass %.

This dispersion liquid was referred as "Colorant Dispersion Liquid 1."

0.055 kg of sodium dodecylbenzenesulfonate was mixed to ion-exchanged water of 4.0 L, and the mixture was stirred and dissolved under room temperature, whereby an anionic surface active agent solution A was obtained.

0.014 kg of Nonyl phenyl alkyl ether was mixed to ion-exchanged water of 4.0 L, and the mixture was stirred and dissolved under room temperature, whereby a nonion surfactant solution A was obtained.

223.8 g of potassium persulfate was mixed to ion-exchanged water of 4.0 L, and the mixture was stirred and dissolved under room temperature, whereby an initiator solution A was obtained.

3.41 kg of polypropylene emulsion having a number average molecular weight (Mn) of 3500, the anionic surface active agent solution A, and the nonion surfactant solution A were put into a reaction chamber of 100 L which was attached with a temperature sensor, a cooling tube, and a nitrogen introduction device, and stirring was started for it. The, 44.0 L of ion-exchanged water were added.

Heating was started and the whole amount of "initiator solution A" was added when the solution temperature reached 70° C. Thereafter, 14.3 kg of styrene, 2.88 kg of n-butyl acrylate, 0.8 kg of methacrylic acid and 548 g of t-dodecyl mercaptan were added while the temperature was controlled at 75° C.±1° C.

Further, the solution temperature was raised to 80° C.±1° C., and stirred with heating for 6 hours. Then, the solution temperature was cooled down to not higher than 40° C. and stirring was stopped, followed by filtration through Pole Filter resulting in preparation of "Latex A1".

Herein, resin particles in Latex A1 had a glass transition temperature of 59° C., a softening point of 116° C., a weight average molecular weight of 13,400 as a molecular weight distribution, and a weight average particle diameter of 125 nm.

Potassium persulfate of 200.7 g was mixed to ion-exchanged water of 12.0 L, and stirring-under room temperature and dissolving was carried out. This solution was referred as an initiator solution B.

The nonion surfactant solution A was put into a reaction chamber of 100 L which was attached with a temperature sensor, a cooling tube, a nitrogen introduction device, and Kushigata baffle plate and stirring was started for it. The, 44.0 L of ion-exchanged water were added.

Heating was started and "initiator solution B" was added when the solution temperature reached 70° C. At this time, a solution in which 11.0 kg of styrene, 4.00 kg of n-butyl acrylate, 1.04 kg of methacrylic acid and 9.02 g of t-dodecyl mercaptan were mixed in advance was added.

Thereafter, heating and stirring were performed for 6 hours while controlling the solution temperature at 72° C.±2° C. Further, the solution temperature was raised to 80° C.±2° C., and stirred with heating for 12 hours.

Then, the solution temperature was cooled down to not higher than 40° C. and stirring was stopped, followed by filtration through Pole Filter resulting in preparation of "Latex B1".

Herein, resin particles in Latex B1 had a glass transition temperature of 58° C., a softening point of 132° C., a weight average molecular weight of 245,000 as a molecular weight distribution and a weight average particle diameter of 110 nm.

Sodium chloride of 5.36 kg as a salting agent and ion-exchanged water of 20.0 L were put in, stirred and dissolved, whereby a sodium chloride solution A was obtained.

Latex A1 of 20.0 kg, Latex B1 of 5.2 kg, 0.4 kg of colorant dispersion 1 and 20.0 kg of ion-exchanged water were put and stirred in a 100 L SUS reaction vessel (agitating blades are anchor wings), equipped with a thermosensor, a cooling tube, a nitrogen gas introducing device and a Kushigata baffle plate. Subsequently, it was heated to 35° C. and sodium chloride solution A was added. Then, after leaving it alone for 5 minutes, temperature rising was started and the liquid temperature was raised to 85° C. in 5 minutes (heating rate=10° C./minutes). At the liquid temperature of 85° C.+2° C., heating and stirring was carried out for 6 hours, and salting-out/fusion were made. Thereafter, the solution was cooled down to not higher than 40° C. and stirring was stopped. It was filtered by a filter having a pore size of 45 micrometers, and let this filtrate was made as an association liquid. Then, non-spherical particles in a wet cake shape were obtained as a filtrate from the association solution by the use of a centrifuge. Thereafter the products were washed with ion-exchanged water.

Coloring particles in the shape of a wet cake for which washing was completed in the above were dried by 40° C. warm air, and whereby coloring particles were obtained. Furthermore, careful classification was carried out with an air classification machine, and whereby coloring particles having a 50% volume particle size (Dv50) of 4.2 micrometers were obtained. Furthermore, 1.0 mass % of hydrophobic silica (a degree of hydrophobilization=70, a number average primary order diameter=12 nm) were added to this coloring particle, and whereby "toner Bk" was obtained.

In production of toner Bk, "Toner Y" was obtained in the similar way with except that 8 parts of C.I. pigment yellow 185 was used instead of 10 parts of carbon black.

In production of toner Bk, "Toner M" was obtained in the similar way with except that 8 parts of C.I. pigment red 122 was used instead of 10 parts of carbon black.

In production of toner Bk, "Toner C" was obtained in the similar way with except that 5 parts of C.I. pigment blue 15:3 was used instead of 10 parts of carbon black.

The volume average particle diameter (here, it means median diameter Dso based on volume) of Toner Bk, Toner Y, Toner M, Toner C are 4.5 μm, 4.3 μm, 4.6 μm, 4.7 μm respectively.

One hundreds parts of the above Carriers 1 to 9 and 4 parts of Toner Bk, Toner Y, Toner M, Toner C were mixed with a V-type agitator (for each one kind of carrier and toner) so as to prepare Developer group 1 (1Bk, 1Y, 1M, 1C) to Developer group 9 (9Bk, 9Y, 9M, 9C).

Evaluation 1 (Evaluation with a Counter Developing Method)

The obtained photoreceptors were mounted on a commercial full color compound machine 8050 (a full color compound machine 8050 (manufactured by Konica Minolta Business Technologies Corp.) employing a tandem method using an intermediate transfer member was modified to a counter developing method), the photoreceptor was charged to −400 V with a charging device, a 405 nm short wavelength laser light source was used as an exposure light source, the exposure diameter (Ld) of a spot exposure is set to be 30 μm 0.5 mW on the surface of the photoreceptor, and a color image evaluation was conducted by the use of each color toner of Y, M, C, Bk. A continuous copy was conducted on A4 size copy sheet with an original image having a white background portion, a solid image portion, a halftone image portion and a character image portion and copy images were evaluated. More concretely, at a stating time and each $5000^{th}$ copy sheet, copy images to be evaluated was sampled and the total 5 copy sheets were evaluated. Evaluation items and evaluation criteria are indicated bellow.

Evaluation Condition

Development: Counter developing method, reversal developing method

Exposure light source: 405 nm short wave laser light source

Charging condition: the absolute value of a charged potential on a photoreceptor at an exposed position: 400 V Line speed of a photoreceptor: 180 mm/sec Peripheral speed ratio (s/Vopc) of a developing sleeve and a photoreceptor: 2.0

Bitten depth of a magnetic brush: 0.3 mm

Distance (Ds) between a developing carrying member (a developing sleeve) and a photoreceptor: 0.25 mm Alternate current component of a developing bias Vac: 1.4 KVp-p Direct current component of a developing bias: −200 V Difference between a surface electric potential Vo of a photoreceptor and a direct current component Vdc of a developing bias (|Vo-Vdc|): 200 V Frequency: 5 KHz Duty ratio: 50% of a rectangular wave Image Evaluation Image density An image density on a copy sheet at a stating time and each $5000^{th}$ copy sheet were measured by the use of a densitometer "RD-918" (made by Macbeth Corp.) as a relative density in which an image density on a printer copy sheet was set to be 0.0.

A: 1.3 or more/Very good

B: 1.0 to 1.3/A level with which there was no problem for a practical use

C: less than 1.0/not good

Fog

A fog density on a copy sheet at a stating time and each $5000^{th}$ copy sheet were measured by the use of a densitometer "RD-918" (made by Macbeth Corp.) as a relative density in which a reflection density on a A4-size copy sheet was set to be 0.000 as to a fog density.

A: Less than 0.010 (Very good)

B: 0.010 to less than 0.020 (A level with which there was no problem for a practical use)

C: 0.020 or more (Not good)

A leading section image density lowering

A halftone image was produced on a $50,000^{th}$ copy sheet and evaluated.

A: A leading section image density lowering was not observed and the halftone image was reproduced clearly. (Very good)

B: Although the halftone image was reproduced clearly, there was a leading section image density lowering less than 0.04 in reflection density. (There was no problem for a practical)

C: There was a leading section image density lowering of 0.04 or more in reflection density on the halftone image.

Carrier adhesion

A: There was almost no carrier adhesion on an organic photoreceptor and an occurrence of damage on a photoreceptor and an occurrence of an image defect due to the carrier adhesion were not observed.

B: Although carrier adhesion was slightly observed, an occurrence of damage on a photoreceptor and an occurrence of an image defect due to the carrier adhesion were not observed.

(Practical Use was Permissible)

C: There were many carrier adhesion, an occurrence of damage on a photoreceptor and an occurrence of an image defect due to the carrier adhesion observed. (Practical use was not permissible)

Dot reproducibility

Dot reproducibility of a toner constructing a toner image was evaluated by viewing with a magnifying glass of a 100 time magnification.

A: The sizes of image dots were reproduced independently with a size of ±30% of an exposed spot area. (Very good)

B: The size of image dots were reproduced independently with an increase or a reduction by 30% to 60% of an exposed spot area. (A level with which there is no problem for a practical use)

C: The size of image dots were increased or reduced over 60% of an exposed spot area and an image dot was partially omitted or linked with another dot. (A level with which there was a problem for a practical use)

Color reproducibility

The color of a solid image portion of a second order color (red, blue, green) in each toner of Y, M, C on an image on a first copy sheet and a $100^{th}$ copy sheet was measured with "MacbethColor-Eye7000" and a color difference of each solid image on the first copy sheet and the $100^{th}$ copy sheet was calculated by the use of a CMC (2:1) color difference formula.

A: The color difference is smaller than 2. (Very good)

B: The color difference is in a range of 2-3. (A level with which there is no problem for a practical use)

C: The color difference is larger than 3. (A level with which there was a problem for a practical use)

A: Color difference was 3 or less (Very good)

C: Color difference was more than 3 (There was a problem for a practical)

The results are indicated in Table 3.

TABLE 3

| Combination No. | Charged potential \|V\| | Photo-receotor No. | Developer group (carrier) No. | Image density | Fog | Image density lowering at leading section | Carrier adhesion | Dot repro-ducibility | Color repro-ducibility | |
|---|---|---|---|---|---|---|---|---|---|---|
| 1 | 400 | 4 | 1 | B | B | B | B | B | B | Inv. |
| 2 | 400 | 4 | 2 | A | A | B | B | A | A | Inv. |
| 3 | 400 | 4 | 3 | A | A | A | A | A | A | Inv. |
| 4 | 400 | 4 | 4 | A | A | A | A | A | A | Inv. |
| 5 | 400 | 4 | 5 | B | B | B | A | B | B | Inv. |
| 6 | 400 | 4 | 6 | B | B | B | B | B | B | Inv. |
| 7 | 400 | 4 | 7 | A | A | A | A | A | A | Inv. |
| 8 | 400 | 4 | 8 | A | A | A | A | A | A | Inv. |
| 9 | 400 | 4 | 9 | B | A | B | A | A | B | Inv. |
| 10 | 400 | 1 | 3 | A | A | A | A | A | A | Inv. |
| 11 | 400 | 2 | 3 | A | A | A | A | A | A | Inv. |
| 12 | 400 | 3 | 3 | A | B | B | A | A | A | Inv. |

As can be seen from Table 3, all the samples showed improved results: In the image evaluation produced by the counter developing method, the absolute value of an unexposed portion of an organic photoreceptor was 250 to 450 V, and the combination Nos. 2-4, 7, 8, 10-12 in which the volume average particle diameter of carriers of 10 to 60 μm and saturation magnetism value of 20 to 80 emu/g were combined indicate a good characteristic in each evaluation item of all of image density, fog, leading portion image density lowering, carrier adhesion, dot reproducibility and color reproducibility.

Evaluation 2 (Evaluation with a Counter Developing Method)

Evaluation was conducted with the similar manner as Evaluation 1 except that the charging condition in the evaluation for the combination No. 3 was changed as indicated in Table 4.

C: worm-like unevenness was slightly observed and there was a problem for a practical.

Color Reproducibility

The color of a solid image portion of a second order color (red, blue, green) in each toner of Y, M, C on an image on a first copy sheet and a $100^{th}$ copy sheet was measured with "MacbethColor-Eye7000" and a color difference of each solid image on the first copy sheet and the $100^{th}$ copy sheet was calculated by the use of a CMC (2:1) color difference formula.

A: Color difference was 3 or less (Very good)

B: Color difference was 2 to 3. (There was no problem for a practical)

C: Color difference was more than 3 (There was a problem for a practical)

The results are indicated in Table 4.

TABLE 4

| Combination No. | Charged potential \|V\| | Photo-receptor No. | Developer group (carrier) No. | Image density | Fog | Image density lowering at leading section | Carrier adhesion | Dot repro-ducibility | Color repro-ducibility | Worm-like unevenness |
|---|---|---|---|---|---|---|---|---|---|---|
| 13 | 220 | 4 | 3 | D | D | D | A | B | D | A |
| 14 | 270 | 4 | 3 | A | A | B | A | A | A | A |
| 15 | 430 | 4 | 3 | A | A | A | A | A | A | A |
| 16 | 500 | 4 | 3 | A | A | D | A | D | B | D |

Evaluation Condition

Charging condition: the absolute value of a charged potential on a photoreceptor at an exposed position: changed to 220V, 270V, 430V, 500V Evaluation Condition Development: Counter developing method, reversal developing method Exposure light source: 405 m short wave laser light source Charging condition: the absolute value of a charged potential on a photoreceptor at an exposed position: 400 V Line speed of a photoreceptor: 180 mm/sec Peripheral speed ratio (s/Vopc) of a developing sleeve and a photoreceptor: 2.0

Bitten depth of a magnetic brush: 0.3 mm

Distance (Ds) between a developing carrying member (a developing sleeve) and a photoreceptor: 0.25 mm Alternate current component of a developing bias Vac: 1.4 KVp-p Difference between a surface electric potential Vo of a photoreceptor and a direct current component Vdc of a developing bias (|Vo-Vdc|): 180V Frequency: 5 KHz Duty ratio: 50% of a rectangular wave Image Evaluation Image evaluation was conducted with the similar manner as Evaluation 1 except of the following items.

Worm-Like Unevenness

A halftone image on a $50{,}000^{th}$ copy sheet was observed with a magnifying glass of a 100 time magnification to check a presence or absence of worm-like unevenness.

A: No worm-like unevenness was observed.

B: Although worm-like unevenness was slightly observed, there was no problem for a practical.

As a result, the combination No. 14 and 15 in which the charging condition was located within the present invention indicate a good characteristic in each evaluation item of all of image density, fog, leading portion image density lowering, carrier adhesion, dot reproducibility, color reproducibility and worm-like unevenness. In contrast, the combination No. 13 in which the absolute value of the charged potential was 220 V indicate that the image density became low, the leading portion image density lowering occurred, and the color reproducibility was deteriorated. Further, the combination No. 16 in which the absolute value of the charged potential was 500 V indicate that the leading portion image density lowering occurred, the dot reproducibility was deteriorated, and the worm-like unevenness occurred appreciably.

Evaluation 2 (Evaluation with a Parallel Developing Method)

Evaluation was conducted with the similar manner as Evaluation 1 except that the parallel developing method, in which the photoreceptors and the developing sleeves are progressed in parallel, is employed.

Evaluation Condition

Charging condition: the absolute value of a charged potential on a photoreceptor at an exposed position: 400 V Line speed of a photoreceptor: 220 mm/sec Line speed of a developing sleeve: 350 mm/sec Development: Parallel developing method, reversal developing method As a result, although the difference between example of the present invention shown in Evaluation 1 and the comparison example could not be clearly exhibited and the leading section image density lowering and the fog were not observed, an electrophotography picture image, in which the image density is lowered and the color reproducibility is deteriorated due to the lack of the density, compared to the counter developing method, is obtained for every combination of them.

With the image forming method and image formation apparatus of the present invention, an excellent electrophotography picture image with high accuracy can be formed by the use of a short wave laser. Further, an occurrence of fog and an image density failure at a leading section which tend to take place in the counter developing method can be prevented, also fine irregularities such as a worm-like unevenness can be eliminated and it is possible to provide an excellent electrophotography picture image having a good dot reproducibility and a good color reproducibility. and the halftone image was reproduced clearly. (Very good)

While the preferred embodiments of the present invention have been described using specific term, such description is for illustrative purpose only, and it is to be understood that changes and variations may be made without departing from the spirit and scope of the appended claims.

What is claimed is:

1. A method for forming an image, comprising:

applying a uniform surface potential to an organic photoreceptor by a charging device;

irradiating light having a wavelength in a range of 350 to 500 nm and emitted from a semiconductor laser or a light emitting diode which is equipped in an exposed device, on said photoreceptor, to form a latent image; and contacting a developing blush, which is formed on a developing sleeve and contains toner and carrier, with said photoreceptor having said latent image so as to form a visible toner image, wherein said developing sleeve is equipped in a developing device;

wherein an absolute value of an electric charge potential of a non-exposed area residing on said organic photoreceptor is in a range of 250 to 450 Volts at an exposing position of said exposing device; and wherein said developing sleeve is rotated in a counter direction, being counter to a rotating direction of said organic photoreceptor.

2. The method of claim 1, wherein a plurality of image forming units, each of which corresponds to each of a plurality of unicolor toner images and includes said charging device, said exposing device and said developing device, are provided for forming a full color image by overlapping said plurality of unicolor toner images with each other.

3. The method of claim 1, wherein a median diameter $D_{50}$ based on volume of said carrier is in a range of 10 to 60 μm, and a saturation magnetic value of said carrier is in a range of 20 to 80 emu/g.

4. The method of claim 3, wherein said carrier comprises composition expressed by following formula:

$$(MnO)x(MgO)y(Fe_2O_3)z,$$

where x+y+z=100 mol %, and a part of at least one of MnO, MgO and $Fe_2O_3$ is substituted by $SnO_2$.

5. The method of claim 1, wherein said carrier comprises composition expressed by following formula:

$$(MnO)x(MgO)y(Fe_2O_3)z,$$

where x+y+z=100 mol %.

6. The method of claim 5, wherein x is 5 to 35 mol %, y is 10 to 45 mol % and z is 45 to 55 mol %.

7. The method of claim 5, wherein a part of at least one of MnO, MgO and $Fe_2O_3$ of the composition is substituted by $SnO_2$.

8. The method of claim 7, wherein said part of at least one of MnO, MgO and $Fe_2O_3$ is substituted by $SnO_2$ in a ratio of 0.5 to 5.0 mol %.

9. The method of claim 1, wherein a surface layer of said organic photoreceptor comprises fine particles, which serve as a lubricant.

10. The method of claim 9, wherein said fine particles include fluororesin particles.

11. The method of claim 1, wherein a surface layer of said organic photoreceptor comprises an anti-oxidizing agent.

12. The method of claim 11, wherein said anti-oxidizing agent includes a hindered phenol anti-oxidizing agent.

13. The method of claim 11, wherein said anti-oxidizing agent includes a hindered amine anti-oxidizing agent.

14. The method of claim 1, wherein peripheral speed ratio of said developing sleeve to said photoreceptor (Vs/Vopc) is 1.2 to 3.0.

* * * * *